US010018391B2

(12) United States Patent
Kibo

(10) Patent No.: US 10,018,391 B2
(45) Date of Patent: Jul. 10, 2018

(54) AIR CONDITIONER

(71) Applicant: DAIKIN INDUSTRIES, LTD., Osaka-shi, Osaka (JP)

(72) Inventor: Kousuke Kibo, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 15/515,099

(22) PCT Filed: Jul. 14, 2015

(86) PCT No.: PCT/JP2015/070120
§ 371 (c)(1),
(2) Date: Mar. 28, 2017

(87) PCT Pub. No.: WO2016/051920
PCT Pub. Date: Apr. 7, 2016

(65) Prior Publication Data

US 2017/0219238 A1 Aug. 3, 2017

(30) Foreign Application Priority Data

Sep. 30, 2014 (JP) ..... 2014-202307
Sep. 30, 2014 (JP) ..... 2014-202308

(51) Int. Cl.
*F25B 49/02* (2006.01)
*F24F 11/30* (2018.01)
(Continued)

(52) U.S. Cl.
CPC ..... *F25B 49/02* (2013.01); *F24F 11/30* (2018.01); *F24F 11/89* (2018.01);
(Continued)

(58) Field of Classification Search
CPC ..... F25B 2700/1931; F25B 2700/13; F25B 5/02; F25B 49/02
See application file for complete search history.

(56) References Cited

U.S. PATENT DOCUMENTS

2007/0214813 A1* 9/2007 Guldali ..... F25B 31/002 62/183
2013/0067944 A1 3/2013 Kibo et al.
2015/0276255 A1 10/2015 Honda et al.

FOREIGN PATENT DOCUMENTS

JP 2011-257126 A 12/2011
WO 2014/061130 A1 4/2014

OTHER PUBLICATIONS

International Preliminary Report of corresponding PCT Application No. PCT/JP2015/010120 dated Oct. 6, 2015.
(Continued)

*Primary Examiner* — Cassey D Bauer
(74) *Attorney, Agent, or Firm* — Global IP Counselors, LLP

(57) ABSTRACT

An air conditioner includes an outdoor unit and a plurality of indoor units connected to the outdoor unit. The outdoor unit sometimes sets an evaporation temperature or a condensation temperature that is different from a value that any of the indoor units has requested from the outdoor unit. The indoor units have indoor-side controllers that perform capacity control that adjusts capacity based on a degree of superheating or a degree of supercooling, an air volume, or an evaporation temperature or a condensation temperature while calculating a requested capacity that is determined from a current room temperature and a set room temperature. The indoor-side controllers, when performing the capacity control, determine at least one of the air volume and a target value of the degree of superheating or the degree of supercooling based on the evaporation temperature or the condensation temperature that is set by the outdoor unit.

20 Claims, 10 Drawing Sheets

(51) Int. Cl.

| | |
|---|---|
| ***F24F 11/89*** | (2018.01) |
| *F25B 13/00* | (2006.01) |
| *F24F 110/10* | (2018.01) |
| *F24F 140/20* | (2018.01) |

(52) U.S. Cl.
CPC ..... *F24F 2110/10* (2018.01); *F24F 2140/20* (2018.01); *F25B 13/00* (2013.01); *F25B 2313/0314* (2013.01); *F25B 2313/0315* (2013.01); *F25B 2600/11* (2013.01); *F25B 2600/19* (2013.01); *F25B 2600/21* (2013.01); *F25B 2600/2513* (2013.01); *F25B 2700/1931* (2013.01); *F25B 2700/1933* (2013.01); *F25B 2700/2104* (2013.01); *F25B 2700/2106* (2013.01)

(56) References Cited

OTHER PUBLICATIONS

European Search Report of corresponding EP Application No. 15 84 7595.4 dated Sep. 22, 2017.
International Search Report of corresponding PCT Application No. PCT/JP2015/070120 dated Oct. 6, 2015.

* cited by examiner

FIG. 9A

● CASE WHERE SYSTEM CAPACITY IS DEFICIENT

| USED INDOOR UNIT | AIR CONDITIONING INDOOR UNIT A | AIR CONDITIONING INDOOR UNIT B | AIR CONDITIONING INDOOR UNIT C | AIR CONDITIONING INDOOR UNIT D |
|---|---|---|---|---|
| SET TEMPERATURE | 27°C | 27°C | 27°C | 27°C |
| AIR CONDITIONING LOAD | QLoa | QLob | QLoc | QLod |
| EVAPORATION TEMPERATURE | 10 °C (DETERMINED BY OUTDOOR-SIDE CONTROLLER) | | | |
| CURRENT AIR CONDITIONING CAPACITY | Q1a(<QLoa) | Q1b(≧QLob) | Q1c(>QLoc) | Q1d(>QLod) |
| CURRENT ROOM TEMPERATURE | 28°C | 27°C | 27°C | 27°C |
| CURRENT AIR VOLUME | 100% | 100% | 85% | 80% |
| REQUESTED EVAPORATION TEMPERATURE (REQUEST ΔTe) | 9°C (−1deg) | 10°C (±0deg) | 11°C (+1deg) | 12°C (+2deg) |

FIG. 9B

● CASE WHERE SYSTEM ENERGY SAVING IDEAL IS BEING REALIZED

| USED INDOOR UNIT | AIR CONDITIONING INDOOR UNIT A | AIR CONDITIONING INDOOR UNIT B | AIR CONDITIONING INDOOR UNIT C | AIR CONDITIONING INDOOR UNIT D |
|---|---|---|---|---|
| SET TEMPERATURE | 27°C | 27°C | 27°C | 27°C |
| AIR CONDITIONING LOAD | QLoa | QLob | QLoc | QLod |
| EVAPORATION TEMPERATURE | 9 °C (DETERMINED BY OUTDOOR-SIDE CONTROLLER) | | | |
| CURRENT AIR CONDITIONING CAPACITY | Q1a(≧QLoa) | Q1b(>QLob) | Q1c(>QLoc) | Q1d(>QLod) |
| CURRENT ROOM TEMPERATURE | 27°C | 27°C | 27°C | 27°C |
| CURRENT AIR VOLUME | 100% | 90% | 75% | 70% |
| REQUESTED EVAPORATION TEMPERATURE (REQUEST ΔTe) | 9°C (±0deg) | 10°C (+1deg) | 11°C (+2deg) | 12°C (+3deg) |

FIG. 10A

● CASE WHERE SYSTEM CAPACITY IS EXCESSIVE

| USED INDOOR UNIT | AIR CONDITIONING INDOOR UNIT A | AIR CONDITIONING INDOOR UNIT B | AIR CONDITIONING INDOOR UNIT C | AIR CONDITIONING INDOOR UNIT D |
|---|---|---|---|---|
| SET TEMPERATURE | 27°C | 27°C | 27°C | 27°C |
| AIR CONDITIONING LOAD | QLoa | QLob | QLoc | QLod |
| EVAPORATION TEMPERATURE | 10 °C (DETERMINED BY OUTDOOR-SIDE CONTROLLER) | | | |
| CURRENT AIR CONDITIONING CAPACITY | Q1a(>QLoa) | Q1b(>QLob) | Q1c(>QLoc) | Q1d(>QLod) |
| CURRENT ROOM TEMPERATURE | 27°C | 27°C | 27°C | 27°C |
| CURRENT AIR VOLUME | 90% | 80% | 70% | 65% |
| REQUESTED EVAPORATION TEMPERATURE (REQUEST ΔTe) | 11°C (+1deg) | 12°C (+2deg) | 13°C (+3deg) | 14°C (+4deg) |

FIG. 10B

● CASE WHERE SYSTEM ENERGY SAVING IDEAL IS BEING REALIZED

| USED INDOOR UNIT | AIR CONDITIONING INDOOR UNIT A | AIR CONDITIONING INDOOR UNIT B | AIR CONDITIONING INDOOR UNIT C | AIR CONDITIONING INDOOR UNIT D |
|---|---|---|---|---|
| SET TEMPERATURE | 27°C | 27°C | 27°C | 27°C |
| AIR CONDITIONING LOAD | QLoa | QLob | QLoc | QLod |
| EVAPORATION TEMPERATURE | 11 °C (DETERMINED BY OUTDOOR-SIDE CONTROLLER) | | | |
| CURRENT AIR CONDITIONING CAPACITY | Q1a(≧QLoa) | Q1b(>QLob) | Q1c(>QLoc) | Q1d(>QLod) |
| CURRENT ROOM TEMPERATURE | 27°C | 27°C | 27°C | 27°C |
| CURRENT AIR VOLUME | 100% | 90% | 80% | 75% |
| REQUESTED EVAPORATION TEMPERATURE (REQUEST ΔTe) | 11°C (±0deg) | 12°C (+1deg) | 13°C (+2deg) | 14°C (+3deg) |

AIR CONDITIONER

CROSS-REFERENCE TO RELATED APPLICATIONS

This U.S. National stage application claims priority under 35 U.S.C. § 119(a) to Japanese Patent Application Nos. 2014-202307 and 2014-202308, both filed in Japan on Sep. 30, 2014, the entire contents of which are hereby incorporated herein by reference.

TECHNICAL HELD

The present invention relates to an air conditioner.

BACKGROUND ART

In recent years, air conditioners that save energy with improved operating efficiency have become more widespread. For example, JP-A No. 2011-257126 discloses an air conditioning apparatus which, when indoor units calculate requested values for an evaporation temperature to be sent to an outdoor unit, performs a capacity calculation using a heat exchange function whose parameters comprise differences between room temperatures and the evaporation temperature, air volumes, and degrees of superheating, and adds to this control margins for the air volumes and the degrees of superheating to thereby save energy.

SUMMARY

Technical Problem

In this connection, in a multi-type air conditioner, each of the plurality of indoor units detects its liquid pipe temperature and requests from the outdoor unit an evaporation temperature convenient for itself. If a certain indoor unit performs capacity control on the basis of the liquid pipe temperature that it itself has detected, the temperature of its own liquid pipe will fluctuate each time another indoor unit switches its thermostat on and off and the air volume will switch frequently with each fluctuation, so there is the concern that stable air conditioning operations will not be realized.

It is an object of the present invention to provide an air conditioner where indoor units can realize stable air conditioning operations regardless of the circumstances of other indoor units.

Solution to Problem

An air conditioner pertaining to a first aspect of the present invention is an air conditioner comprising an outdoor unit and a plurality of indoor units connected to the outdoor unit, with the outdoor unit sometimes setting an evaporation temperature or a condensation temperature that is different from the value of an evaporation temperature or a condensation temperature that any of the indoor unit has requested from the outdoor unit, wherein the indoor units have indoor-side controllers. The indoor-side controllers perform capacity control. The capacity control is control that adjusts capacity on the basis of a degree of superheating or a degree of supercooling, an air volume, or an evaporation temperature or a condensation temperature while calculating a requested capacity that is determined from a current room temperature and a set room temperature. The indoor-side controllers, in the capacity control, determine the air volume and/or a target value for the degree of superheating or the degree of supercooling on the basis of the evaporation temperature or the condensation temperature that is set by the outdoor unit.

In this air conditioner, the indoor-side controllers determine the air volume and/or a target value for the degree of superheating or the degree of supercooling on the basis of the evaporation temperature or the condensation temperature that is set by the outdoor unit, so each indoor unit achieves a stable air volume and/or degree of superheating or degree of supercooling regardless of the circumstances of the other indoor units. As a result, stable air conditioning operations can be realized.

An air conditioner pertaining to a second aspect of the present invention is the air conditioner pertaining to the first aspect, wherein the indoor-side controllers select the most energy saving combination out of combinations of the degree of superheating or the degree of supercooling and the air volume that realize the requested capacity in the capacity control.

In this air conditioner, the room temperature is prevented from departing from the target value, and the refrigerant-side heat transfer coefficient becomes higher because of the optimization of the degree of superheating or the degree of supercooling, so the air volume can be minimized, which saves energy.

An air conditioner pertaining to a third aspect of the present invention is the air conditioner pertaining to the first aspect, wherein the indoor-side controllers request the outdoor unit to decrease the evaporation temperature or increase the condensation temperature when the indoor-side controllers cannot ensure the requested capacity in the capacity control.

For example, the indoor-side controllers send a requested evaporation temperature to the outdoor unit. However, the outdoor unit sets, as the target evaporation temperature, the evaporation temperature for which it is necessary to raise an operating frequency of the compressor the most out of the evaporation temperatures requested by the indoor-side controllers, so things do not go as all of the indoor-side controllers request.

However, in a case where a certain indoor-side controller requested a severe (low) evaporation temperature in order to eliminate a capacity deficiency and the requested evaporation temperature was lower than the evaporation temperatures requested by the other indoor-side controllers, the requested evaporation temperature becomes the target evaporation temperature and the capacity control expected by that indoor-side controller can be performed.

An air conditioner pertaining to a fourth aspect of the present invention is the air conditioner pertaining to any one of the first aspect to the third aspect, wherein the indoor-side controllers perform the capacity control while periodically calculating the requested capacity. When there has been a change in the target value of the degree of superheating or the degree of supercooling, the set value of the air volume, or the target value of the evaporation temperature or the condensation temperature, the indoor-side controllers perform interrupt capacity control that interrupts without waiting for the periodic calculation by the capacity control and calculates and updates the requested capacity.

For example, if the indoor-side controllers were to continue the former control as is and wait for the periodic capacity calculation when there has been a change in the target value of the degree of superheating or the degree of supercooling, the set value of the air volume, or the target value of the evaporation temperature or the condensation temperature, the room temperature would depart from the target value.

However, in this air conditioner, when there has been a change in the target value of the degree of superheating or the degree of supercooling, the set value of the air volume, or the target value of the evaporation temperature or the condensation temperature, the indoor-side controllers interrupt without waiting for the periodic calculation by the capacity control and calculate and update with an appropriate requested capacity, so the room temperature can be prevented from departing from the target value.

An air conditioner pertaining to a fifth aspect of the present invention is the air conditioner pertaining to the fourth aspect, wherein the indoor-side controllers select the most energy saving combination out of combinations of the degree of superheating or the degree of supercooling and the air volume that realize the requested capacity that was updated.

In this air conditioner, the room temperature is prevented from departing from the target value, and the refrigerant-side heat transfer coefficient becomes higher because of the optimization of the degree of superheating or the degree of supercooling, so the air volume can be minimized, which saves energy.

An air conditioner pertaining to a sixth aspect of the present invention is the air conditioner pertaining to the fourth aspect or the fifth aspect, wherein the indoor-side controllers, in the interrupt capacity control, calculate an evaporation temperature or a condensation temperature to request from the outdoor unit in order to minimize a temperature difference between the current room temperature and the evaporation temperature or the condensation temperature.

In this air conditioner, it is not always the case that the evaporation temperature or the condensation temperature that a certain indoor-side controller has sought for itself from the air conditioning outdoor unit is reflected in the next target evaporation temperature or target condensation temperature, and there are also instances where the requested evaporation temperature or the requested condensation temperature sought by another indoor-side controller is reflected, but the requested evaporation temperature or the requested condensation temperature sought by one of the indoor-side controllers is reflected in the next target evaporation temperature or target condensation temperature, which saves energy in the overall system including the outdoor unit.

An air conditioner pertaining to a seventh aspect of the present invention is the air conditioner pertaining to the fourth aspect, wherein the indoor-side controllers, when periodically calculating the requested capacity in the capacity control, calculate a requested value for the evaporation temperature or the condensation temperature to request from the outdoor unit. When the indoor-side controllers have received input of a target value for the evaporation temperature or the condensation temperature from the outdoor unit, the indoor-side controllers execute the interrupt capacity control regardless of whether or not the target value matches the requested value that was output to the outdoor unit.

In a multi-type air conditioner, a target value for the evaporation temperature or the condensation temperature that is different from those requested by air conditioning indoor units is set.

Therefore, in this air conditioner, the indoor-side controllers prevent the room temperature from departing from the target value by performing the interrupt capacity control that calculates and updates with an appropriate requested capacity at the timing when a target value for the evaporation temperature or the condensation temperature has been set.

An air conditioner pertaining to an eighth aspect of the present invention is the air conditioner pertaining to the fourth aspect, wherein the indoor-side controllers execute the interrupt capacity control when the target value for the degree of superheating or the degree of supercooling has been changed in control outside the capacity control or when the indoor-side controllers have received input of a target value for the degree of superheating or the degree of supercooling from the outdoor unit.

In an air conditioner, sometimes a target value for the evaporation temperature or the condensation temperature that is different from those requested by the indoor units is set due to the protection logic of the indoor units or compulsion from the outdoor unit.

Therefore, in this air conditioner, the indoor-side controllers prevent the room temperature from departing from the target value by performing the interrupt capacity control that calculates and updates with an appropriate requested capacity at the timing when a target value for the degree of superheating or the degree of supercooling has been set.

An air conditioner pertaining to a ninth aspect of the present invention is the air conditioner pertaining to the fourth aspect, wherein the indoor-side controllers receive input of a set value for the air volume via one of an automatic air volume mode, in which the air volume is set automatically, and a manual air volume mode, in which the air volume is set manually. The indoor-side controllers execute the interrupt capacity control when they have received input of a set value for the air volume by the manual air volume mode.

In this air conditioner, for example, the indoor-side controllers prevent the room temperature from departing from the target value by performing the interrupt capacity control that calculates and updates an appropriate requested capacity at the timing when an air volume setting has been made by a user operating a remote controller.

Advantageous Effects of Invention

In the air conditioner pertaining to the first aspect of the present invention, the indoor-side controllers determine the air volume and/or a target value for the degree of superheating or the degree of supercooling on the basis of the evaporation temperature or the condensation temperature that is set by the outdoor unit, so each indoor unit achieves a stable air volume and/or degree of superheating or degree of supercooling regardless of the circumstances of the other indoor units. As a result, stable air conditioning operations can be realized.

In the air conditioner pertaining to the second aspect of the present invention, the room temperature is prevented from departing from the target value, and the refrigerant-side heat transfer coefficient becomes higher because of the optimization of the degree of superheating or the degree of supercooling, so the air volume can be minimized, which saves energy.

In the air conditioner pertaining to the third aspect of the present invention, in a case where a certain indoor-side controller requested a severe (low) evaporation temperature in order to eliminate a capacity deficiency and the requested evaporation temperature was lower than the evaporation temperatures requested by the other indoor-side controllers, the requested evaporation temperature becomes the target evaporation temperature and the capacity control expected by that indoor-side controller can be performed.

In the air conditioner pertaining to the fourth aspect of the present invention, when there has been a change in the target value of the degree of superheating or the degree of supercooling, the set value of the air volume, or the target value of the evaporation temperature or the condensation temperature, the indoor-side controllers interrupt without waiting for the periodic calculation by the capacity control and calculate and update with an appropriate requested capacity, so the room temperature can be prevented from departing from the target value.

In the air conditioner pertaining to the fifth aspect of the present invention, the room temperature is prevented from departing from the target value, and the refrigerant-side heat transfer coefficient becomes higher because of the optimization of the degree of superheating or the degree of supercooling, so the air volume can be minimized, which saves energy.

In the air conditioner pertaining to the sixth aspect of the present invention, the requested evaporation temperature or requested condensation temperature sought by one of the indoor-side controllers is reflected in the next target evaporation temperature or target condensation temperature, which saves energy in the overall system including the outdoor unit.

In the air conditioner pertaining to the seventh aspect of the present invention, the indoor-side controllers prevent the room temperature from departing from the target value by performing the interrupt capacity control that calculates and updates with an appropriate requested capacity at the timing when a target value for the evaporation temperature or the condensation temperature has been set.

In the air conditioner pertaining to the eighth aspect of the present invention, the indoor-side controllers prevent the room temperature from departing from the target value by performing the interrupt capacity control that calculates and updates with an appropriate requested capacity at the timing when a target value for the degree of superheating or the degree of supercooling has been set.

In the air conditioner pertaining to the ninth aspect of the present invention, for example, the indoor-side controllers prevent the room temperature from departing from the target value by performing the interrupt capacity control that calculates and updates with an appropriate requested capacity at the timing when an air volume setting has been made by a user operating a remote controller.

BRIEF DESCRIPTION OF DRAWINGS

FIG. 9A is a table showing room temperatures of air conditioning target spaces, and air volumes and an evaporation temperature of air conditioning indoor units, in a case where system capacity is deficient.

FIG. 9B is a table showing room temperatures of the air conditioning target spaces, and air volumes and an evaporation temperature of the air conditioning indoor units, in a case where an ideal state is being realized in the system from the standpoint of saving energy.

FIG. 10A is a table showing room temperatures of air conditioning target spaces, and air volumes and an evaporation temperature of air conditioning indoor units, in a case where system capacity is excessive.

FIG. 10B is a table showing room temperatures of the air conditioning target spaces, and air volumes and an evaporation temperature of the air conditioning indoor units, in a case where an ideal state is being realized in the system from the standpoint of saving energy.

DESCRIPTION OF EMBODIMENT

An embodiment of the present invention will be described below with reference to the drawings. It should be noted that the following embodiment is a specific example of the present invention and is not intended to limit the technical scope of the present invention.

(1) Configuration of Air Conditioner 10

Figure 1:
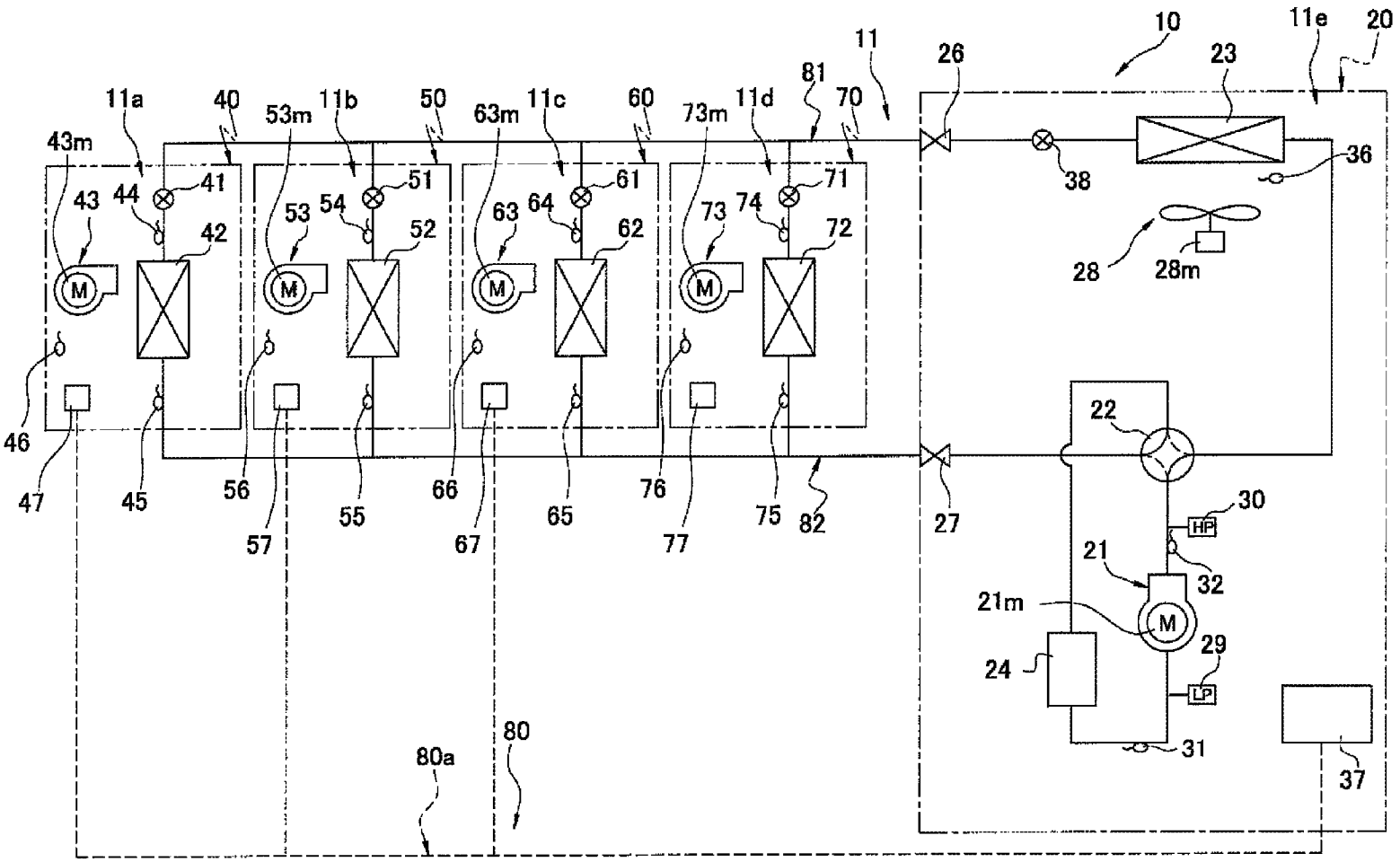
FIG. 1 is a general configuration diagram of an air conditioner pertaining to an embodiment of the present invention.

FIG. 1 is a general configuration diagram of an air conditioner 10 pertaining to an embodiment of the present invention. The air conditioner 10 is an apparatus that cools and heats rooms in a building or the like by means of a vapor compression refrigeration cycle. The air conditioner 10 is equipped with one air conditioning outdoor unit 20, plural (in the present embodiment, four) air conditioning indoor units 40, 50, 60, and 70 connected in parallel to the air conditioning outdoor unit 20, and a liquid refrigerant communication pipe 81 and a gas refrigerant communication pipe 82 that interconnect the air conditioning outdoor unit 20 and the air conditioning indoor units 40, 50, 60, and 70.

A refrigerant circuit 11 of the air conditioner 10 is configured by the interconnection of the air conditioning outdoor unit 20, the air conditioning indoor units 40, 50, 60, and 70, and the liquid refrigerant communication pipe 81 and the gas refrigerant communication pipe 82.

(1-1) Air Conditioning Indoor Units 40, 50, 60, and 70

The air conditioning indoor units 40, 50, 60, and 70 are installed by embedding them in or suspending them from ceilings of rooms in a building or the like or mounting them on walls of the rooms.

The air conditioning indoor unit 40 and the air conditioning indoor units 50, 60, and 70 have the same configuration, so here just the configuration of the air conditioning indoor unit 40 will be described, and as regards the configurations of the air conditioning indoor units 50, 60, and 70, reference numerals in the 50s, 60s, or 70s will be assigned thereto instead of reference numerals in the 40s denoting parts of the air conditioning indoor unit 40, and description of each part will be omitted.

The air conditioning indoor unit 40 has an indoor-side refrigerant circuit 11*a* (an indoor-side refrigerant circuit 11*b* in the air conditioning indoor unit 50, an indoor-side refrigerant circuit 11*c* in the air conditioning indoor unit 60, and an indoor-side refrigerant circuit 11*d* in the air conditioning indoor unit 70) that configures part of the refrigerant circuit 11. The indoor-side refrigerant circuit 11*a* includes an indoor expansion valve 41 and an indoor heat exchanger 42. It should be noted that although in the present embodiment indoor expansion valves 41, 51, 61, and 71 are provided in the air conditioning indoor units 40, 50, 60, and 70, respectively, the air conditioner 10 is not limited to this; an expansion mechanism (including an expansion valve) may also be provided in the air conditioning outdoor unit 20 or may also be provided in a connection unit independent of the air conditioning indoor units 40, 50, 60, and 70 and the air conditioning outdoor unit 20.

(1-1-1) Indoor Expansion Valve 41

The indoor expansion valve 41 is an electrically powered expansion valve. The indoor expansion valve 41 is connected to the liquid side of the indoor heat exchanger 42 in order to adjust the flow rate of the refrigerant flowing inside the indoor-side refrigerant circuit 11*a*. Furthermore, the indoor expansion valve 41 can also cut off the passage of the refrigerant.

(1-1-2) Indoor Heat Exchanger 42

The indoor heat exchanger 42 is a cross fin-type fin and tube heat exchanger configured by heat transfer tubes and numerous fins. The indoor heat exchanger 42 during the cooling operation functions as a refrigerant evaporator to cool the room air and during the heating operation functions as a refrigerant condenser to heat the room air.

It should be noted that although in the present embodiment the indoor heat exchanger 42 is a cross fin-type fin and tube heat exchanger, the indoor heat exchanger 42 is not limited to this and may also be another type of heat exchanger.

(1-1-3) Indoor Fan 43

The air conditioning indoor unit 40 has an indoor fan 43. The indoor fan 43 sucks room air into the air conditioning indoor unit 40, allows the room air to exchange heat with refrigerant in the indoor heat exchanger 42, and thereafter supplies the air to the room as supply air. Furthermore, the indoor fan 43 can change, in a predetermined air volume range, the volume of the air it supplies to the indoor heat exchanger 42.

In the present embodiment the indoor fan 43 is a centrifugal fan or a multi-blade fan driven by a motor 43*m* comprising a DC fan motor or the like. Furthermore, in the indoor fan 43, a fixed air volume mode and an automatic air volume mode can be selected via an input device such as a remote controller.

Here, the fixed air volume mode is a mode in which the air volume may be set to any of three levels of fixed air volumes: low, in which the air volume is the lowest; high, in which the air volume is the highest; and medium, in which the air volume is in the middle between low and high. Furthermore, the automatic air volume mode is a mode in which the air volume is automatically changed anywhere from low to high in accordance with a degree of superheating SH or a degree of supercooling SC.

For example, in a case where the user has selected one of "low", "medium", and "high", the air volume mode switches to the fixed air volume mode, and in a case where the user has selected "automatic", the air volume mode switches to the automatic air volume mode in which the air volume is changed automatically in accordance with the operating state.

It should be noted that in the present embodiment the fan tap for the air volume of the indoor fan 43 is switched in three stages: "low", "medium", and "high". Here, the number of stages in which the fan tap is switched is not limited to three stages and may also be ten stages, for example.

Furthermore, an air volume Ga of the indoor fan 43 is calculated on the basis of the rotational speed of the motor 43*m*. Here, the air volume Ga may also be calculated on the basis of the electrical current value in the motor 43*m* or may also be calculated on the basis of the fan tap that has been set.

(1-1-4) Various Types of Sensors

The air conditioning indoor unit 40 is provided with various types of sensors. First, a liquid-side temperature sensor 44 is provided on the liquid side of the indoor heat exchanger 42. The liquid-side temperature sensor 44 detects the refrigerant temperature corresponding to a condensation temperature Tc in the heating operation or the refrigerant temperature corresponding to an evaporation temperature Te in the cooling operation.

Furthermore, a gas-side temperature sensor 45 is provided on the gas side of the indoor heat exchanger 42. The gas-side temperature sensor 45 detects the temperature of the refrigerant.

Furthermore, a room temperature sensor 46 is provided on the room air inlet side of the air conditioning indoor unit 40. The room temperature sensor 46 detects the temperature of the room air (that is, a room temperature Tr) flowing into the air conditioning indoor unit 40.

In the present embodiment the liquid-side temperature sensor 44, the gas-side temperature sensor 45, and the room temperature sensor 46 comprise thermistors.

(1-1-5) Indoor-Side Controller 47

Figure 2:
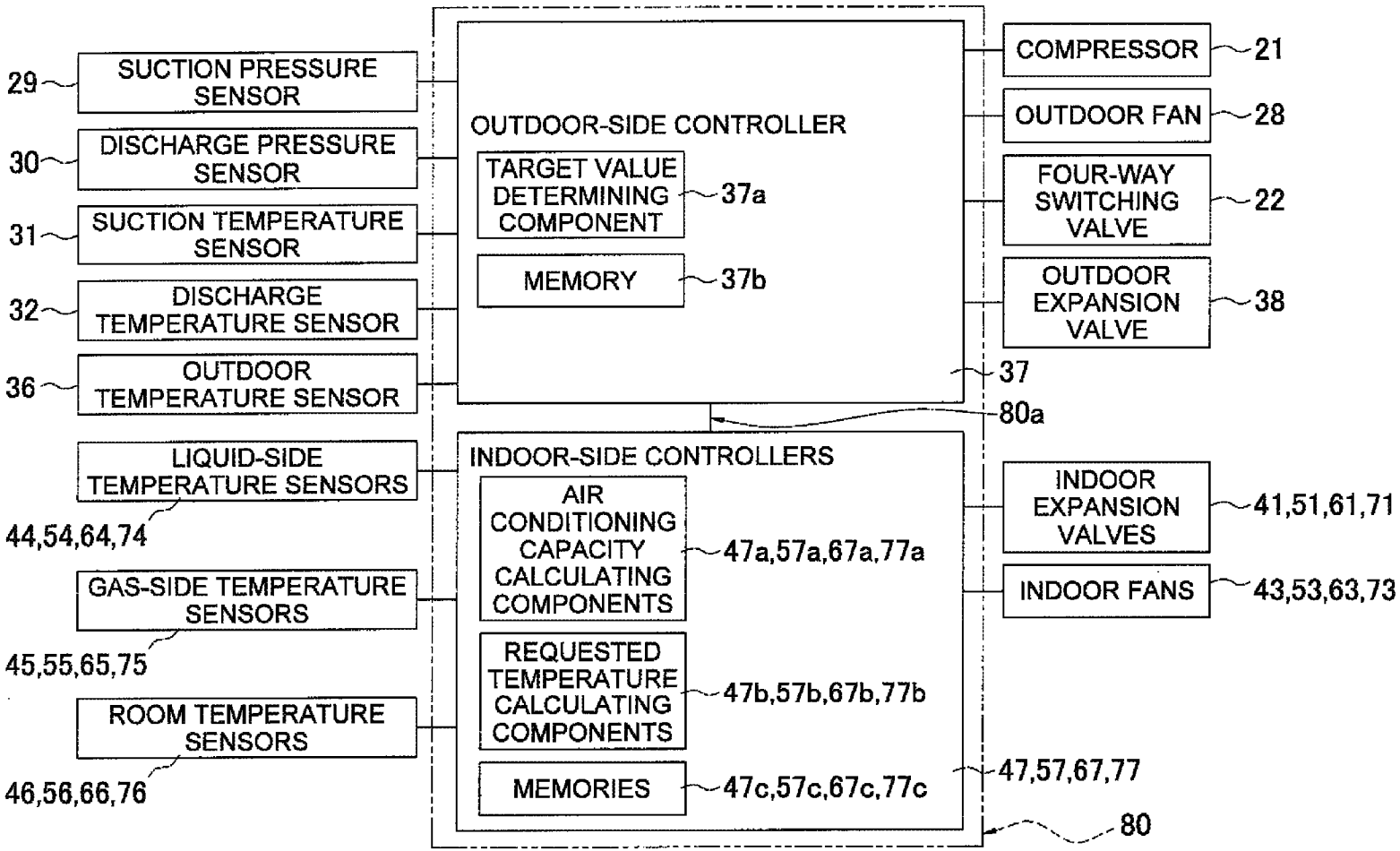
FIG. 2 is a block diagram showing a controller of the air conditioner.

FIG. 2 is a block diagram showing a controller of the air conditioner. In FIG. 2, the air conditioning indoor unit 40 has an indoor-side controller 47. The indoor-side controller 47 controls the operation of each part configuring the air conditioning indoor unit 40. The indoor-side controller 47 includes an air conditioning capacity calculating component 47*a*, a requested temperature calculating component 47*b*, and a memory 47*c*.

The air conditioning capacity calculating component 47*a* calculates the current air conditioning capacity and the like in the air conditioning indoor unit 40. Furthermore, the requested temperature calculating component 47*b* calculates a requested evaporation temperature Ter or a requested condensation temperature Tcr necessary to next exhibit a capacity on the basis of the current air conditioning capacity. The memories 47*c*, 57*c*, 67*c*, and 77*c* store various types of data.

Furthermore, the indoor-side controller 47 communicates control signals and the like with a remote controller (not shown in the drawings) for individually operating the air conditioning indoor unit 40 and furthermore communicates control signals and the like via a transmission line 80*a* with the air conditioning outdoor unit 20.

(1-2) Air Conditioning Outdoor Unit 20

The air conditioning outdoor unit 20 is installed outside a building or the like, is connected via the liquid refrigerant communication pipe 81 and the gas refrigerant communication pipe 82 to the air conditioning indoor units 40, 50, 60, and 70, and configures the refrigerant circuit 11 together with the air conditioning indoor units 40, 50, 60, and 70.

The air conditioning outdoor unit 20 has an outdoor-side refrigerant circuit 11*e* that configures part of the refrigerant circuit 11. The outdoor-side refrigerant circuit 11*e* has a compressor 21, a four-way switching valve 22, an outdoor heat exchanger 23, an outdoor expansion valve 38, an accumulator 24, a liquid-side stop valve 26, and a gas-side stop valve 27.

(1-2-1) Compressor 21

The compressor 21 is a variable capacity compressor, and as concerns the driving of a motor 21*m* thereof its rotational speed is controlled by an inverter. In the present embodiment there is just one compressor 21, but the number of compressors is not limited to this, and two or more compressors may also be connected in parallel in accordance with the number of air conditioning indoor units connected.

(1-2-2) Four-way Switching Valve 22

The four-way switching valve 22 is a valve that switches the direction of the flow of the refrigerant. During the cooling operation the four-way switching valve 22 interconnects the discharge side of the compressor 21 and the gas side of the outdoor heat exchanger 23 and also interconnects the suction side of the compressor 21 (specifically, the accumulator 24) and the gas refrigerant communication pipe 82 (a cooling operation state: see the solid lines of the four-way switching valve 22 in FIG. 1).

As a result, the outdoor heat exchanger 23 functions as a refrigerant condenser and the indoor heat exchangers 42, 52, 62, and 72 function as refrigerant evaporators.

During the heating operation the four-way switching valve 22 interconnects the discharge side of the compressor 21 and the gas refrigerant communication pipe 82 and also interconnects the suction side of the compressor 21 and the gas side of the outdoor heat exchanger 23 (a heating operation state: see the dashed lines of the four-way switching valve 22 in FIG. 1).

As a result, the indoor heat exchangers 42, 52, 62, and 72 function as refrigerant condensers and the outdoor heat exchanger 23 functions as a refrigerant evaporator.

(1-2-3) Outdoor Heat Exchanger 23

The outdoor heat exchanger 23 is a cross fin-type fin and tube heat exchanger. However, the outdoor heat exchanger 23 is not limited to this and may also be another type of heat exchanger.

The outdoor heat exchanger 23 during the cooling operation functions as a refrigerant condenser and during the heating operation functions as a refrigerant evaporator. The gas side of the outdoor heat exchanger 23 is connected to the four-way switching valve 22 and the liquid side of the outdoor heat exchanger 23 is connected to the outdoor expansion valve 38.

(1-2-4) Outdoor Expansion Valve 38

The outdoor expansion valve 38 is an electrically powered valve and adjusts the pressure and flow rate of the refrigerant flowing inside the outdoor-side refrigerant circuit 11*e*. The outdoor expansion valve 38 is disposed on the downstream side of the outdoor heat exchanger 23 in the flow direction of the refrigerant in the refrigerant circuit 11 during the cooling operation.

(1-2-5) Outdoor Fan 28

The outdoor fan 28 delivers outdoor air it has sucked in to the outdoor heat exchanger 23 and allows the outdoor air to exchange heat with refrigerant. The outdoor fan 28 can vary the volume of the outdoor air when delivering the outdoor air to the outdoor heat exchanger 23. The outdoor fan 28 is a propeller fan or the like and is driven by a motor 28*m* comprising a DC, fan motor or the like.

(1-2-6) Liquid-Side Stop Valve 26 and Gas-Side Stop Valve 27

The liquid-side stop valve 26 and the gas-side stop valve 27 are valves provided in openings connecting to the liquid refrigerant communication pipe 81 and the gas refrigerant communication pipe 82.

The liquid-side stop valve 26 is disposed on the downstream side of the outdoor expansion valve 38 and the upstream side of the liquid refrigerant communication pipe 81 in the flow direction of the refrigerant in the refrigerant circuit 11 during the cooling operation. The gas-side stop valve 27 is connected to the four-way expansion valve 22. The liquid-side stop valve 26 and the gas-side stop valve 27 can cut off the passage of the refrigerant.

(1-2-7) Various Types of Sensors

The air conditioning outdoor unit 20 is provided with a suction pressure sensor 29, a discharge pressure sensor 30, a suction temperature sensor 31, a discharge temperature sensor 32, and an outdoor temperature sensor 36.

The suction pressure sensor 29 detects the suction pressure of the compressor 21. The suction pressure is the refrigerant pressure corresponding to an evaporation pressure Pe in the cooling operation.

The discharge pressure sensor 30 detects the discharge pressure of the compressor 21. The discharge pressure is the refrigerant pressure corresponding to a condensation pressure Pc in the heating operation.

The suction temperature sensor 31 detects the suction temperature of the compressor 21. Furthermore, the discharge temperature sensor 32 detects the discharge temperature of the compressor 21. The outdoor temperature sensor 36 detects the temperature of the outdoor air (hereinafter called the "outdoor temperature") flowing into the air conditioning outdoor unit 20 on the outdoor air inlet side of the air conditioning outdoor unit 20.

The suction temperature sensor 31, the discharge temperature sensor 32, and the outdoor temperature sensor 36 comprise thermistors.

(1-2-8) Outdoor-side Controller 37

Furthermore, as shown in FIG. 2, the air conditioning outdoor unit 20 has an outdoor-side controller 37. The outdoor-side controller 37 has a target value determining component 37*a*, a memory 37*b*, and an inverter circuit (not shown in the drawings). The target value determining component 37*a* determines a target evaporation temperature Tet or a target condensation temperature Tet. The memory 37*b* stores various types of data.

The outdoor-side controller 37 communicates control signals and the like via the transmission line 80*a* with the indoor-side controllers 47, 57, 67, and 77 of the air conditioning indoor units 40, 50, 60, and 70.

(1-3) Controller 80

A controller 80 is configured by the indoor-side controllers 47, 57, 67, and 77, the outdoor-side controller 37, and the transmission line 80*a*. The controller 80 is connected to the various types of sensors and controls the various types of devices on the basis of detection signals and the like from the various types of sensors.

(1-4) Refrigerant Communication Pipes 81 and 82

The refrigerant communication pipes 81 and 82 are refrigerant pipes constructed on site when installing the air conditioner 10 in an installation location such as a building. For the refrigerant communication pipes 81 and 82, refrigerant pipes having a variety of lengths and pipe diameters are used in accordance with installation conditions such as the installation location and the combination of the air conditioning outdoor unit and the air conditioning indoor units, so when installing the air conditioner 10, the air conditioner 10 is charged with the proper quantity of refrigerant according to the installation conditions such as the lengths and pipe diameters of the refrigerant communication pipes 81 and 82.

(2) Control Scheme

In the air conditioner 10, in the cooling operation and the heating operation, control that brings room temperatures Tr closer to set temperatures Ts that users have set by means of an input device such as a remote controller is performed with respect to each of the air conditioning indoor units 40, 50, 60, and 70. Here, an overview of the control scheme will be described.

Figure 3:
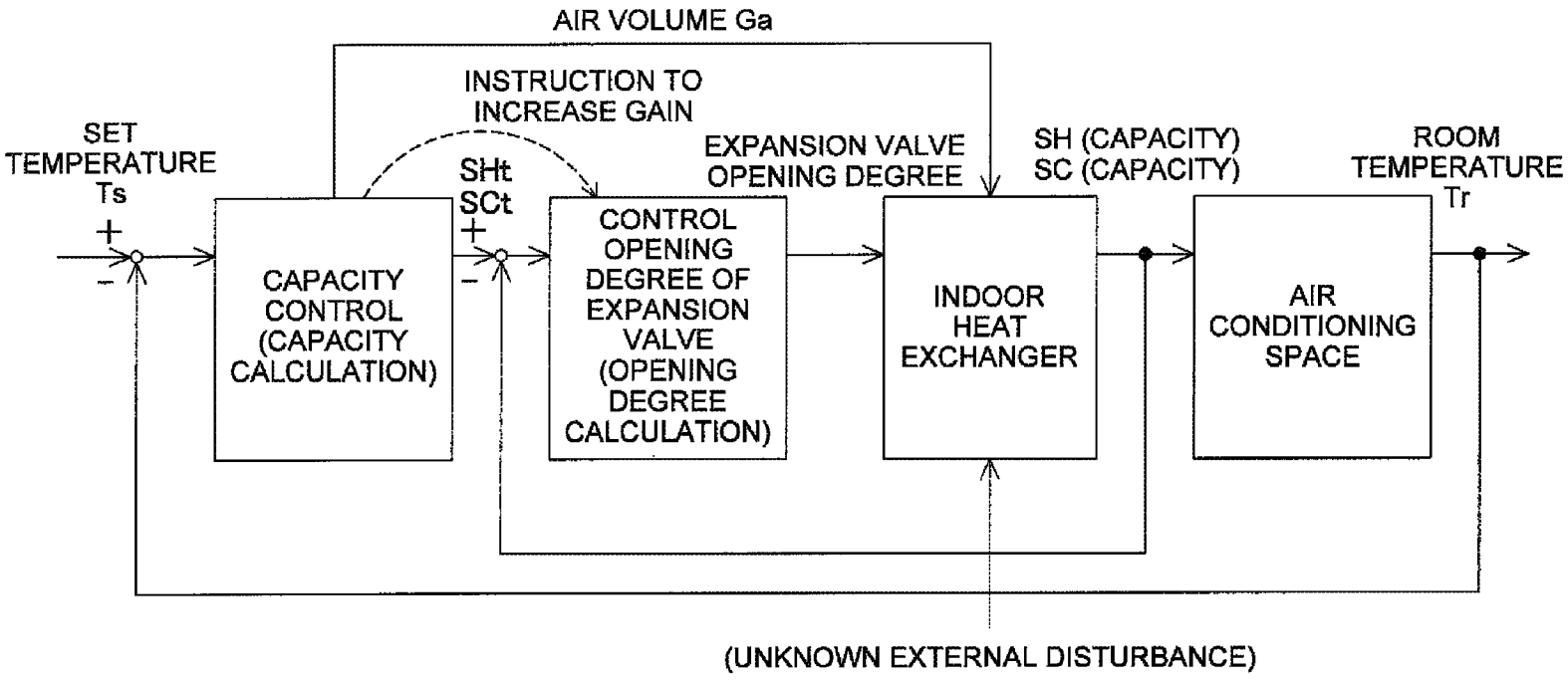
FIG. 3 is a block diagram showing a process for causing a room temperature to converge to a set temperature.

FIG. 3 is a block diagram showing a process for causing a room temperature to converge to a set temperature. In HG 2 and HG 3, the indoor-side controllers 47, 57, 67, and 77 determine a target value for the degree of superheating SH or the degree of supercooling SC in capacity control so that the room temperature Tr becomes the set temperature Ts. Specifically, a target value for the degree of superheating SM (hereinafter called the "degree of superheating target value SHt") or a target value for the degree of supercooling SC (hereinafter called the "degree of supercooling target value SCt") for realizing the necessary air conditioning capacity in a way that saves energy is calculated.

Next, the indoor-side controllers 47, 57, 67, and 77 calculate the opening degree of the indoor expansion valves 41, 51, 61, and 71 on the basis of the degree of superheating target value Slit or the degree of supercooling target value SCt and perform control so that the opening degree of the indoor expansion valves 41, 51, 61, and 71 becomes the opening degree that was found by the calculation.

Then, the degree of superheating SH or the degree of supercooling SC increases or decreases in accordance with the opening degree of the indoor expansion valves 41, 51, 61, and 71, and the energy (heat exchange amount) supplied from the indoor heat exchangers 42, 52, 62, and 72 to the air conditioning spaces increases or decreases, so that a change appears wherein the room temperatures comes closer to the set temperature. The detection value of the room temperature Tr is input to a process of "capacity calculation" in the capacity control.

Furthermore, in the present embodiment a cascade control scheme with a double loop configuration comprising capacity control and expansion valve opening degree control is employed.

(2-1) Capacity Control

When the indoor-side controllers 47, 57, 67, and 77 have received input indicating that a particular operating mode such as the cooling operation has been selected via a remote controller (not shown in the drawings), for example, the indoor-side controllers 47, 57, 67, and 77 request that the outdoor-side controller 37 start up the compressor 21, and capacity control is started. The capacity control will be described below with reference to the drawings.

Figure 4:
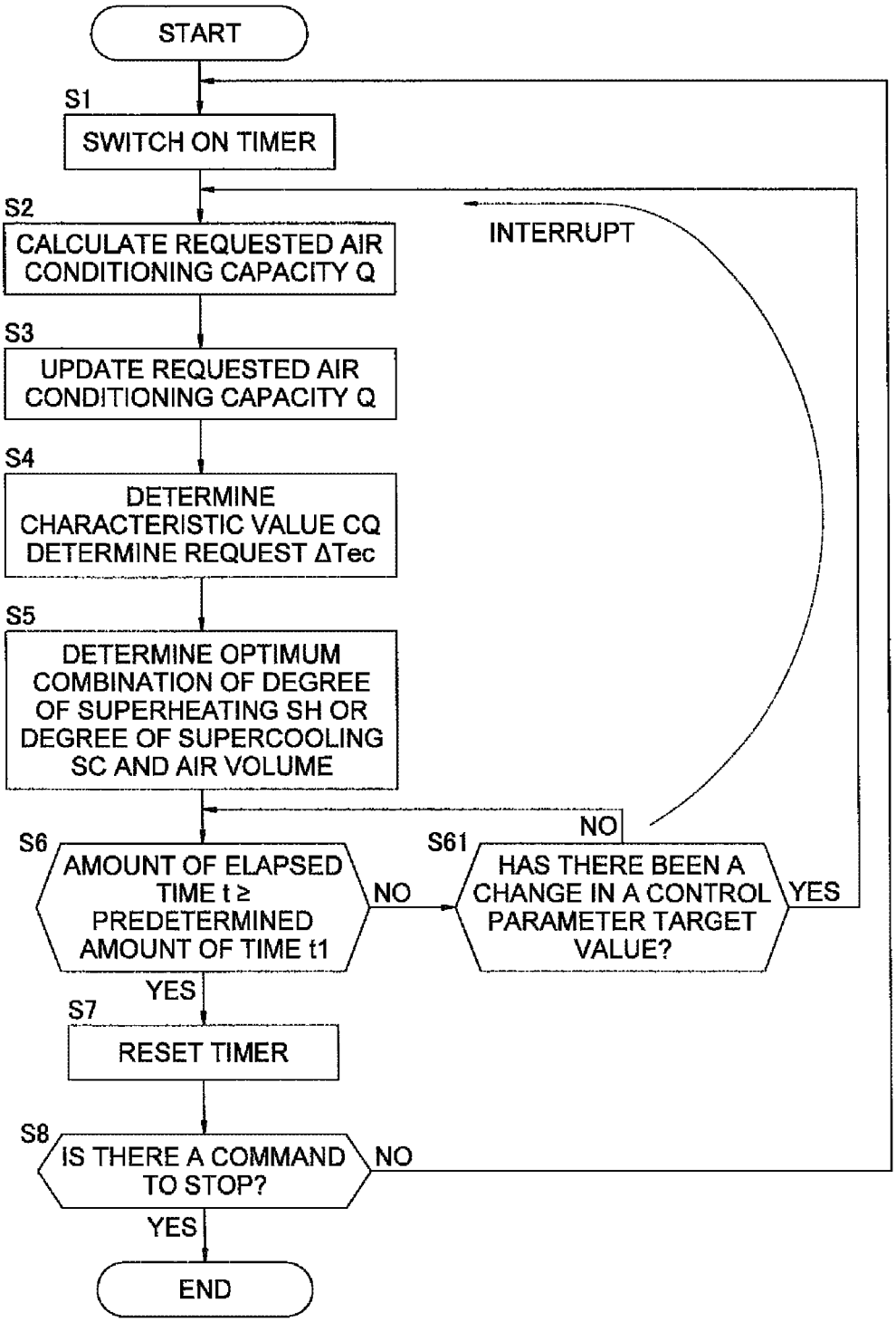
FIG. 4 is a flowchart of capacity control.

FIG. 4 is a flowchart of the capacity control. In FIG. 4, when the capacity control is started, the indoor-side controllers 47, 57, 67, and 77 switch on a timer in step S1 and then proceed to step S2.

Next, in step S2 the indoor-side controllers 47, 57, 67, and 77 calculate a requested air conditioning capacity Q. The requested air conditioning capacity Q is calculated by calculating the current air conditioning capacity of the air conditioning indoor units 40, 50, 60, and 70, calculating a capacity difference ΔQ representing excess or deficiency in the current air conditioning capacity on the basis of the temperature difference between the room temperature Tr and the set temperature Ts, and adding the capacity difference ΔQ to the current air conditioning capacity.

Next, in step S3 the indoor-side controllers 47, 57, 67, and 77 update the former requested air conditioning capacity Q to the newly calculated requested air conditioning capacity Q.

Next, in step S4 the indoor-side controllers 47, 57, 67, and 77 determine a predetermined characteristic value CQ and a request ΔTec, which is sent to the outdoor-side controller 37, on the basis of the requested air conditioning capacity Q and the most recent target evaporation temperature Tet or target condensation temperature Tct that has been acquired from the outdoor-side controller 37.

Here, the characteristic value CQ and the request ΔTec will be described. The requested air conditioning capacity Q is the product of a term f(ΔT), which is determined by a difference ΔT between the room temperature Tr and the most recent target evaporation temperature Tet or target condensation temperature Tct that has been supplied from the outdoor-side controller 37, a term g(G), which is determined by the air volume U and a term h(SCH), which is determined by the degree of superheating SH or the degree of supercooling SC; namely, $Q=f(\Delta T)\cdot g(G)\cdot h(SCH)$, and this is called the "heat exchange function". The value representing the product of term g(G) and term h(SCH)—that is to say, g(G)·h (SCH)—which the air conditioning indoor units 40, 50, 60, and 70 can freely control in this heat exchange function is called the characteristic value CQ.

Furthermore, the air conditioning indoor units 40, 50, 60, and 70 cannot freely control the target evaporation temperature Tet or the target condensation temperature let, but in order to realize the requested air conditioning capacity Q in a way that saves more energy they calculate an evaporation temperature Te or a condensation temperature Tc that is different from the target evaporation temperature let or the target condensation temperature Tct that has been supplied from the outdoor-side controller 37. At that time, the air conditioning indoor units 40, 50, 60, and 70 determine, as the request ΔTec, the difference between the room temperature Tr and the calculated evaporation temperature Te or condensation temperature Tc, and send the request ΔTec to the outdoor-side controller 37. It should be noted that the method of determining the request ΔTec is disclosed in detail in patent document 1 (JP-A No. 2011-257126) cited in the "Background Art" section, so description thereof will be omitted in the present application.

Next, in step S5 the indoor-side controllers 47, 57, 67, and 77 determine, from among combinations of the term g(G) and the term h(SCH) that satisfy the characteristic value CQ, the term h(SCH) resulting in the highest refrigerant-side heat transfer coefficient and use the degree of superheating SH or the degree of supercooling SC at that time as the degree of superheating target value SHt or the degree of supercooling target value SCt. The remaining term g(G) is automatically determined from the characteristic value CQ and the term h (SCH) that has been determined earlier.

Next, in step S6 the indoor-side controllers 47, 57, 67, and 77 determine whether or not an amount of elapsed time t since starting the count has reached a predetermined amount of time t1 (e.g., 3 minutes); when $t \geq t1$, the indoor-side controllers 47, 57, 67, and 77 proceed to step S7, and when $t < t1$, the indoor-side controllers 47, 57, 67, and 77 proceed to step S61.

Next, the indoor-side controllers 47, 57, 67, and 77 reset the timer in step S7 and then proceed to step S8.

Then, in step S8 the indoor-side controllers 47, 57, 67, and 77 determine whether or not there has been a command to stop operating; when there was not a stop command, the indoor-side controllers 47, 57, 67, and 77 return to step S1.

As described above, the capacity control is control that periodically (e.g., every three minutes) updates the requested air conditioning capacity in order to cause the room temperature Tr to converge to the set temperature Ts.

(2-2) Interrupt Capacity Control

However, in a case where the target evaporation temperature Tet or the target condensation temperature Tct, the degree of superheating target value SHt or the degree of supercooling target value SCt, or the air volume set value has been changed to a value unintended by the indoor-side controllers 47, 57, 67, and 77, there is the concern that by itself the control described above, which periodically updates the requested air conditioning capacity Q, will not keep the room temperature Tr from departing from the target value in the time until the updating of the requested air conditioning capacity Q, leading to a drop in comfort and a drop in control stability.

Therefore, in the present embodiment, when there has been a change in the target evaporation temperature Tet or the target condensation temperature Tct, the degree of superheating target value SHt or the degree of supercooling target value SCt, or the air volume set value, the indoor-side controllers 47, 57, 67, and 77 employ interrupt capacity control that interrupts without waiting for the periodic calculation of the requested air conditioning capacity Q and calculates and updates with an appropriate requested air conditioning capacity Q. This is what happens from step S61 on.

In FIG. 4, when the indoor-side controllers 47, 57, 67, and 77 have judged in step S6 that the amount of elapsed time t has not yet reached the predetermined amount of time t1 (e.g., 3 minutes), the indoor-side controllers 47, 57, 67, and 77 proceed to step S61 and determine whether or not there has been a change in a control parameter target value.

Specifically, the indoor-side controllers 47, 57, 67, and 77 determine whether or not there has been a change in the target evaporation temperature Tet or the target condensation temperature Tct, the degree of superheating target value SHt or the degree of supercooling target value SCt, or the air volume set value; when there has been a change in any of these, the indoor-side controllers 47, 57, 67, and 77 return to step S2, calculate the requested air conditioning capacity on the basis of the changed control parameter target value, and in step S3 update the former requested air conditioning capacity to the newly calculated requested air conditioning capacity.

By performing the interrupt capacity control described above, the indoor-side controllers 47, 57, 67, and 77 prevent the room temperature Tr from departing from the target value in the time until the updating of the requested air conditioning capacity.

(3) Operation of Air Conditioner 10

Here, the operation of the air conditioner 10 resulting from the capacity control will be described using the cooling operation and the heating operation as examples.

(3-1) Cooling Operation

During the cooling operation the four-way switching valve 22 interconnects the discharge side of the compressor 21 and the gas side of the outdoor heat exchanger 23 and also interconnects the suction side of the compressor 21 and the gas sides of the indoor heat exchangers 42, 52, 62, and 72 (the state indicated by the solid lines in FIG. 1).

Furthermore, the outdoor expansion valve 38 is completely open. The liquid-side stop valve 26 and the gas-side stop valve 27 are open. The opening degrees of the indoor expansion valves 41, 51, 61, and 71 are adjusted so that the degree of superheating SH of the refrigerant in the refrigerant outlets of the indoor heat exchangers 42, 62, and 72 becomes fixed at the degree of superheating target value SHt.

The degree of superheating target value SHt is set to an optimum value so that the room temperature Tr converges to the set temperature Ts in the predetermined degree of superheating range. In the present embodiment the degree of superheating SH of the refrigerant in the refrigerant outlets of the indoor heat exchangers 42, 52, 62, and 72 is calculated by subtracting the detection value (corresponding to the evaporation temperature Te) detected by the liquid-side temperature sensors 44, 54, 64, and 74 from the detection value detected by the gas-side temperature sensors 45, 55, 65, and 75.

However, the degree of superheating SH of the refrigerant in the outlets of the indoor heat exchangers 42, 52, 62, and 72 is not limited to being calculated just by the method described above and may also be calculated by converting the suction pressure of the compressor 21 detected by the suction pressure sensor 29 to the saturation temperature value corresponding to the evaporation temperature Te and subtracting the saturation temperature value from the detection value detected by the gas-side temperature sensors 45, 55, 65, and 75.

Furthermore, although it is not employed in the present embodiment, the degree of superheating SH of the refrigerant in the outlets of the indoor heat exchangers 42, 52, 62, and 72 may also be detected by providing temperature sensors that detect the temperature of the refrigerant flowing inside the indoor heat exchangers 42, 52, 62, and 72 and subtracting the refrigerant temperature value corresponding to the evaporation temperature Te detected by the temperature sensor from the detection value detected by the gas-side temperature sensors 45, 55, 65, and 75.

When the compressor 21, the outdoor fan 28, and the indoor fans 43, 53, 63, and 73 are operated in this state of the refrigerant circuit 11, low-pressure gas refrigerant is sucked into the compressor 21, compressed, and becomes high-pressure gas refrigerant. Thereafter, the high-pressure gas refrigerant is sent via the four-way switching valve 22 to the outdoor heat exchanger 23, exchanges heat with outdoor air supplied by the outdoor fan 28, condenses, and becomes high-pressure liquid refrigerant. Then, the high-pressure liquid refrigerant is sent via the liquid-side stop valve 26 and the liquid refrigerant communication pipe 81 to the air conditioning indoor units 40, 50, 60, and 70.

The high-pressure liquid refrigerant that has been sent to the air conditioning indoor units 40, 50, 60, and 70 has its pressure reduced close to the suction pressure of the compressor 21 by the indoor expansion valves 41, 51, 61, and 71, becomes low-pressure refrigerant in a gas-liquid two-phase state, is sent to the indoor heat exchangers 42, 52, 62, and 72, exchanges heat with room air in the indoor heat exchangers 42, 52, 62, and 72, evaporates, and becomes low-pressure gas refrigerant.

The low-pressure gas refrigerant is sent via the gas refrigerant communication pipe 82 to the air conditioning outdoor unit 20 and flows via the gas-side stop valve 27 and the four-way switching valve 22 into the accumulator 24. Then, the low-pressure gas refrigerant that has flowed into the accumulator 24 is sucked back into the compressor 21.

In this way, the air conditioner 10 can perform the cooling operation that causes the outdoor heat exchanger 23 to function as a refrigerant condenser and causes the indoor heat exchangers 42, 52, 62, and 72 to function as refrigerant evaporators.

It should be noted that because the air conditioner 10 does not have mechanisms that adjust the pressure of the refrigerant on the gas sides of the indoor heat exchangers 42, 52, 62, and 72, the evaporation pressure Pe in all of the indoor heat exchangers 42, 52, 62, and 72 becomes a shared pressure.

(3-1-1) Details of Step S2 in Cooling Operation

Figure 5:
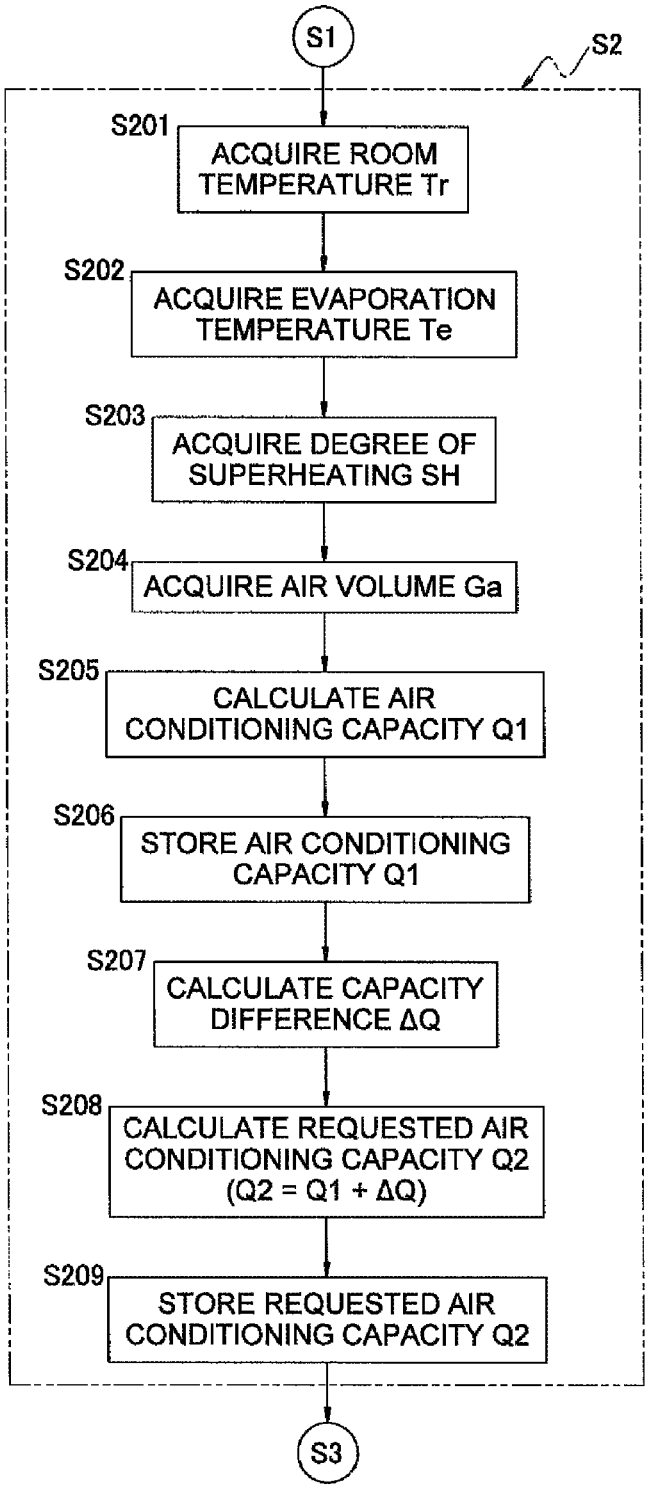
FIG. 5 is a detailed flowchart of step S2 of FIG. 4 during a cooling operation.

Here, the process of calculating the requested air conditioning capacity during the cooling operation will be described. FIG. 5 is a detailed flowchart of step S2 of FIG. 4 during the cooling operation. The process will be described below with reference to FIG. 2 to FIG. 5.

First, in step S201 the indoor-side controllers 47, 57, 67, and 77 acquire the current room temperature Tr via the room temperature sensors 46, 56, 66, and 76.

Next, in step S202 the indoor-side controllers 47, 57, 67, and 77 acquire the current evaporation temperature Te via the liquid-side temperature sensors 44, 54, 64, and 74.

Next, in step S203 the indoor-side controllers 47, 57, 67, and 77 acquire the current degree of superheating SH by subtracting, from the detection value of the gas-side temperature sensors 45, 55, 65, and 75, the corresponding evaporation temperature Te acquired in step S202.

Next, in step S204 the indoor-side controllers 47, 57, 67, and 77 acquire the current air volume Ga produced by the indoor fans 43, 53, 63, and 73.

Next, in step S205 the indoor-side controllers 47, 57, 67, and 77 calculate, via the air conditioning capacity calculating components 47*a*, 57*a*, 67*a*, and 77*a*, a current air conditioning capacity Q1 in the air conditioning indoor units 40, 50, 60, and 70 on the basis of the temperature difference <ΔT> that is the temperature difference between the current room temperature Tr and the current evaporation temperature Te, the air volume Ga produced by the indoor fans 43, 53, 63, and 73, and the degree of superheating SH. It should be noted that the air conditioning capacity Q1 may also be calculated by employing the evaporation temperature Te instead of the temperature difference <ΔT>.

Next, in step S206 the indoor-side controllers 47, 57, 67, and 77 store the air conditioning capacity Q1 in the memories 47*c*, 57*c*, 67*c*, and 77*c*.

Next, in step S207 the indoor-side controllers 47, 57, 67, and 77 calculate, via the air conditioning capacity calculating components 47*a*, 57*a*, 67*a*, and 77*a*, the capacity difference ΔQ representing excess or deficiency in the air conditioning capacity Q1 in the room space from the temperature difference between the room temperature Tr and the set temperature Ts that the current user has set by means of a remote controller or the like.

Next, in step S208 the indoor-side controllers 47, 57, 67, and 77 add the capacity difference ΔQ to the stored air conditioning capacity Q1 to find a requested air conditioning capacity Q2.

Next, in step S209 the indoor-side controllers 47, 57, 67, and 77 store the requested air conditioning capacity Q2 in the memories 47*c*, 57*c*, 67*c*, and 77*c*.

In step S3 of FIG. 4 the former requested air conditioning capacity Q2 is updated to the new requested air conditioning capacity Q2 that was stored in step S209. Then, the characteristic value CQ is determined in step S4 of FIG. 4 in order to realize, in a way that saves energy, the requested air conditioning capacity Q2 that has been updated.

The characteristic value CQ is determined by the degree of superheating SH and the air volume, so an optimum combination must be determined to realize energy saving, and this determination is made in step S5.

(3-1-2) Details of Step S5 in Cooling Operation

The characteristic value CQ is a value representing the product of term g(G) and term h(SCH) which the air conditioning indoor units 40, 50, 60, and 70 can freely control, so the number of combinations of the degree of superheating SH and the air volume that realize the characteristic value CQ is countless. The air conditioning indoor units 40, 50, 60, and 70 determine, from among those combinations, a combination resulting in a higher refrigerant-side heat transfer coefficient.

It is not the case that there is an order of priority between the degree of superheating SH and the air volume; the combination resulting in the best refrigerant-side heat transfer coefficient is a low degree of superheating and a low air volume.

For example, a settable range is determined beforehand for the degree of superheating SH, so in the case of the automatic air volume mode, if there is an air volume with which the characteristic value CQ can be realized at a degree of superheating minimum SHmin in the degree of superheating settable range, the indoor-side controllers 47, 57, 67, and 77 combine that air volume.

It should be noted that the minimum SHmin is the optimum value for the degree of superheating SH, but if the air volume fluctuates at the minimum the risk of wetness increases, so from the standpoint of reliability there are also instances where a degree of superheating that is higher than the minimum is set even during the cooling operation.

Furthermore, in the case of the automatic air volume mode, if there is no air volume with which the characteristic value CQ can be realized at the degree of superheating minimum SHmin in the degree of superheating settable range, the indoor-side controllers 47, 57, 67, and 77 select and determine, from the degree of superheating settable range, a degree of superheating SH with which the characteristic value CQ can be realized at an air volume minimum and, if there is an air volume with which the characteristic value CQ can be realized at that determined degree of superheating SH, combine that air volume.

On the other hand, in the case of the fixed air volume mode, there is no longer the freedom to select the air volume, so the degree of superheating SH that realizes the characteristic value CQ at that fixed air volume is unequivocally determined.

(3-1-3) Details of Interrupt Capacity Control in Cooling Operation

The indoor-side controllers 47, 57, 67, and 77 use the degree of superheating SH determined in step S5 as the degree of superheating target value SHt and adjust the opening degree of each of the indoor expansion valves 41, 51, 61, and 71 so that the degree of superheating SH of the refrigerant in the refrigerant outlets of the indoor heat exchangers 42, 52, 62, and 72 becomes the degree of superheating target value SM.

The indoor-side controllers 47, 57, 67, and 77 next update the requested air conditioning capacity Q2 after the predetermined amount of time t1 (e.g., three minutes) since the most recent updating, but in a case where there has been a change in the target evaporation temperature Tet, the degree of superheating target value SHt, or the air volume set value during the predetermined amount of time t1, the indoor-side controllers 47, 57, 67, and 77 calculate and update the requested air conditioning capacity Q2 without waiting for the elapse of the predetermined amount of time t1. This is the interrupt capacity control in the cooling operation.

In the interrupt capacity control, when the indoor-side controllers 47, 57, 67, and 77 have received the target evaporation temperature Tet from the outdoor-side controller 37, or when some kind of protective control works so that the degree of superheating target value SHt must be changed, or when the air volume has been fixed, the indoor-side controllers 47, 57, 67, and 77 perform step S2 to step S4 of FIG. 4 and combine the degree of superheating and the air volume with which the newly determined characteristic value CQ can be realized.

For example, when the target evaporation temperature let has changed, term f(ΔT) of Q2=f(ΔT)·g(G)·h(SCH) changes even if there is no substantial change in the requested air conditioning capacity Q2 before and after updating, so the characteristic value CQ that is g(G)·h(SCH) also changes.

In order to realize the new characteristic value CQ, in the case of the automatic air volume mode, if there is an air volume with which the characteristic value CQ can be realized at the degree of superheating minimum SHmin in the degree of superheating settable range, the indoor-side controllers 47, 57, 67, and 77 combine that air volume. If there is no air volume with which the characteristic value CQ can be realized at the degree of superheating minimum SHmin, the indoor-side controllers 47, 57, 67, and 77 select, from the degree of superheating settable range, a degree of superheating SH with which the characteristic value CQ can be realized at the air volume minimum.

In the case of the fixed air volume mode, there is no longer the freedom to select the air volume, so the degree of superheating SH that realizes the new characteristic value CQ at that fixed air volume is unequivocally determined.

On the other hand, in a case where, in the automatic air volume mode, the degree of superheating target value SHt has been changed due to protective control, there is no substantial change in the requested air conditioning capacity Q2 before and after updating and there is also no change in term f(ΔT), so the value of the characteristic value CQ does not change and an air volume with which the characteristic value CQ can be realized at the changed degree of superheating target value SHt is determined.

Furthermore, even in a case where the air volume mode has been changed by the user from the automatic air volume mode to the fixed air volume mode, there is no substantial change in the requested air conditioning capacity Q2 before and after updating and there is also no change in term f(ΔT), so the value of the characteristic value CQ does not change, a degree of superheating SH with which the characteristic value CQ can be realized at the fixed air volume is determined, and that becomes the degree of superheating target value SW.

However, there are cases where, as a result of the air volume having been set to the minimum air volume, the requested air conditioning capacity Q2 cannot be realized even if the degree of superheating minimum SHmin in the degree of superheating settable range is selected. That is to say, these are cases where the requested air conditioning capacity Q2 cannot be realized even when term g(G) of Q2=f(ΔT)·g(G)·h(SH) is a minimum and term h(SH) is a maximum (optimum).

This time it is necessary to increase term f(ΔT) in order to realize the requested air conditioning capacity Q2, so the indoor-side controllers 47, 57, 67, and 77 send to the outdoor-side controller 37 an evaporation temperature to be requested (the requested evaporation temperature Ter) in order to change term f(ΔT) to the necessary magnitude.

In this way, in the present embodiment normally the indoor-side controllers 47, 57, 67, and 77 perform the capacity control that updates the requested air conditioning capacity Q2 every predetermined amount of time t1 in order to cause the room temperature Tr to converge to the set temperature Ts, and when there has been a change in the target evaporation temperature let, the degree of superheating target value SHt, or the air volume set value during the predetermined amount of time t1, the indoor-side controllers 47, 57, 67, and 77 perform the interrupt capacity control to thereby prevent the room temperature Tr from departing from the target value in the time until the updating of the requested air conditioning capacity Q2.

(3-2) Heating Operation

During the heating operation the four-way switching valve 22 interconnects the discharge side of the compressor 21 and the gas sides of the indoor heat exchangers 42, 52, 62, and 72 and also interconnects the suction side of the compressor 21 and the gas side of the outdoor heat exchanger 23 (the state indicated by the dashed lines in FIG. 1).

Furthermore, the opening degree of the outdoor expansion valve 38 is adjusted so as to reduce the pressure of the refrigerant flowing into the outdoor heat exchanger 23 to a pressure (that is, the evaporation pressure Pe) capable of causing the refrigerant to evaporate in the outdoor heat exchanger 23. The liquid-side stop valve 26 and the gas-side stop valve 27 are open. The opening degrees of the indoor expansion valves 41, 51, 61, and 71 are adjusted so that the degree of supercooling SC of the refrigerant in the outlets of the indoor heat exchangers 42, 52, 62, and 72 becomes fixed at the degree of supercooling target value SCt.

The degree of supercooling target value SCt is set to an optimum temperature value that the room temperature Tr converges to the set temperature Ts in the degree of supercooling range specified in accordance with the operating state at that time. In the present embodiment the degree of supercooling SC of the refrigerant in the outlets of the indoor heat exchangers 42, 52, 62, and 72 is detected by converting a discharge pressure Pd of the compressor 21 detected by the discharge pressure sensor 30 to the saturation temperature value corresponding to the condensation temperature Tc and subtracting, from the saturation temperature value of the refrigerant, the refrigerant temperature value detected by the liquid-side temperature sensors 44, 54, 64, and 74.

It should be noted that, although it is not employed in the present embodiment, the degree of supercooling SC of the refrigerant in the outlets of the indoor heat exchangers 42, 52, 62, and 72 may also be detected by providing temperature sensors that detect the temperature of the refrigerant flowing inside the indoor heat exchangers 42, 52, 62, and 72 and subtracting the refrigerant temperature value corresponding to the condensation temperature Tc detected by the temperature sensor from the refrigerant temperature value detected by the liquid-side temperature sensors 44, 54, 64, and 74.

When the compressor 21, the outdoor fan 28, and the indoor fans 43, 53, 63, and 73 are operated in this state of the refrigerant circuit 11, low-pressure gas refrigerant is sucked into the compressor 21, compressed, becomes high-pressure gas refrigerant, and is sent via the four-way switching valve 22, the gas-side stop valve 27, and the gas refrigerant communication pipe 82 to the air conditioning indoor units 40, 50, 60, and 70.

The high-pressure gas refrigerant that has been sent to the air conditioning indoor units 40, 50, 60, and 70 exchanges heat with room air, condenses, and becomes high-pressure liquid refrigerant in the indoor heat exchangers 42, 52, 62, and 72, and thereafter has its pressure reduced in accordance with the valve opening degree of the indoor expansion valve 41, 51, 61, and 71 when it passes through the indoor expansion valves 41, 51, 61, and 71.

The refrigerant that has passed through the indoor expansion valves 41, 51, 61, and 71 is sent via the liquid refrigerant communication pipe 81 to the air conditioning outdoor unit 20, has its pressure further reduced via the liquid-side stop valve 26 and the outdoor expansion valve 38, and flows into the outdoor heat exchanger 23.

The low-pressure refrigerant in the gas-liquid two-phase state that has flowed into the outdoor heat exchanger 23 exchanges heat with outdoor air supplied by the outdoor fan 28, evaporates, becomes low-pressure gas refrigerant, and flows via the four-way switching valve 22 into the accumulator 24.

The low-pressure gas refrigerant that has flowed into the accumulator 24 is sucked back into the compressor 21. It should be noted that because the air conditioner 10 does not have mechanisms that adjust the pressure of the refrigerant on the gas sides of the indoor heat exchangers 42, 52, 62, and 72, the condensation pressure Pc in all of the indoor heat exchangers 42, 52, 62, and 72 becomes a shared pressure.

(3-2-1) Details of Step S2 in Heating Operation

Figure 6:
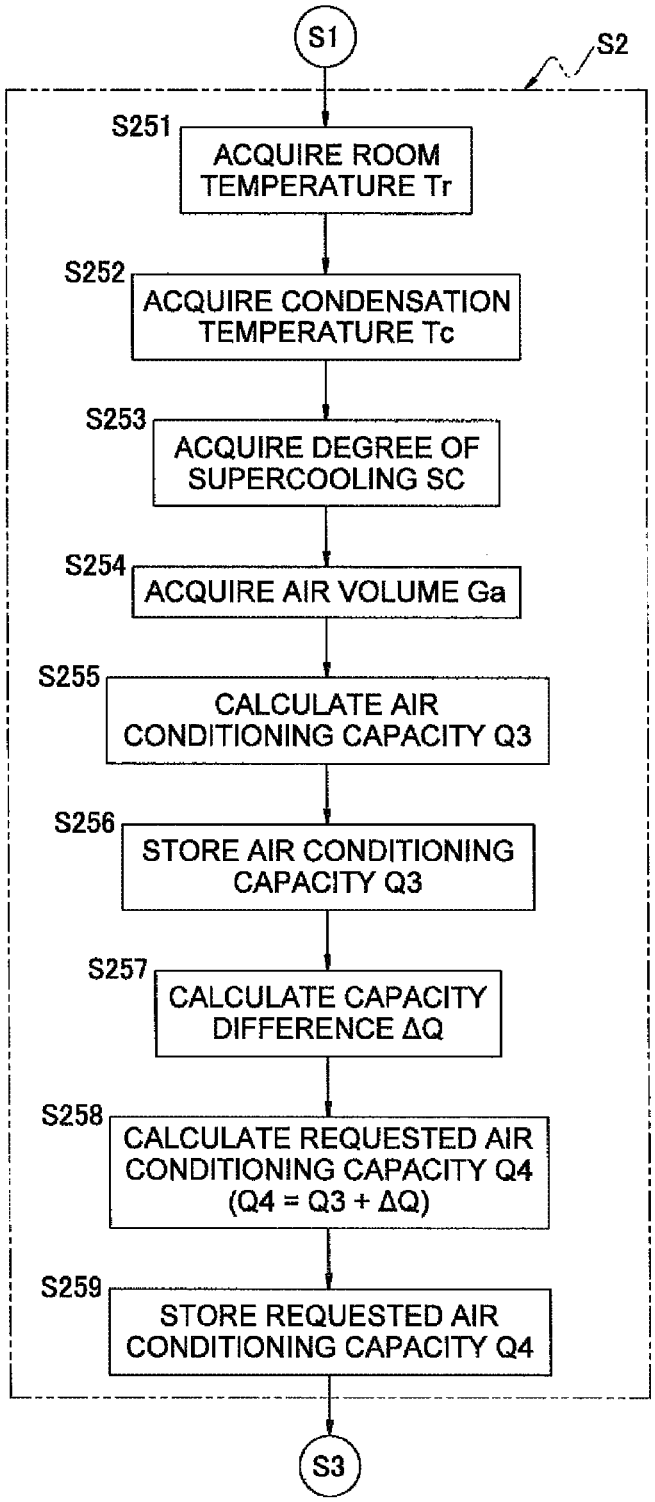
FIG. 6 is a detailed flowchart of step S2 of FIG. 4 during a heating operation.

Here, the process of calculating the requested air conditioning capacity during the heating operation will be described. FIG. 6 is a detailed flowchart of step S2 of FIG. 4 during the heating operation. The process will be described below with reference to FIG. 2 to FIG. 4 and FIG. 6.

First, in step S251 the indoor-side controllers 47, 57, 67, and 77 acquire the current room temperature Tr via the room temperature sensors 46, 56, 66, and 76.

Next, in step S252 the indoor-side controllers 47, 57, 67, and 77 acquire the current condensation temperature Tc via the liquid-side temperature sensors 44, 54, 64, and 74.

Next, in step S253 the indoor-side controllers 47, 57, 67, and 77 acquire the current degree of supercooling SC by converting the detection value of the discharge pressure sensor 30 to the saturation temperature value corresponding to the condensation temperature Tc and subtracting, from the saturation temperature value, the detection value of the liquid-side temperature sensors 44, 54, 64, and 74.

Next, in step S254 the indoor-side controllers 47, 57, 67, and 77 acquire the current air volume Ga produced by the indoor fans 43, 53, 63, and 73.

Next, in step S255 the indoor-side controllers 47, 57, 67, and 77 calculate, via the air conditioning capacity calculating components 47*a*, 57*a*, 67*a*, and 77*a*, a current air conditioning capacity Q3 in the air conditioning indoor units 40, 50, 60, and 70 on the basis of the temperature difference ΔT that is the temperature difference between the current room temperature Tr and the current condensation temperature Tc, the air volume Ga produced by the indoor fans 43, 53, 63, and 73, and the degree of supercooling SC. It should be noted that the air conditioning capacity Q3 may also be calculated by employing the condensation temperature Tc instead of the temperature difference ΔT.

Next, in step S256 the indoor-side controllers 47, 57, 67, and 77 store the air conditioning capacity Q3 in the memories 47*c*, 57*c*, 67*c*, and 77*c*.

Next, in step S257 the indoor-side controllers 47, 57, 67, and 77 calculate, via the air conditioning capacity calculating components 47*a*, 57*a*, 67*a*, and 77*a*, the capacity difference ΔQ representing excess or deficiency in the air conditioning capacity Q3 in the room space from the temperature difference between the room temperature Tr and the set temperature Ts that the current user has set by means of a remote controller or the like.

Next, in step S258 the indoor-side controllers 47, 57, 67, and 77 add the capacity difference ΔQ to the air conditioning capacity Q3 to find a requested air conditioning capacity Q4.

Next, in step S259 the indoor-side controllers 47, 57, 67, and 77 store the requested air conditioning capacity Q4 in the memories 47*c*, 57*c*. 67*c*, and 77*c*.

In step S3 of FIG. 4 the former requested air conditioning capacity Q4 is updated to the new requested air conditioning capacity Q4 that was stored in step S259. Then, the characteristic value CQ is determined in step S4 of FIG. 4 in order to realize, in a way that is energy saving, the requested air conditioning capacity Q4 that has been updated.

The characteristic value CQ is determined by the degree of supercooling SC and the air volume, so an optimum combination must be determined to realize energy saving, and this determination is made in step S5.

(3-2-2) Details of Step S5 in Heating Operation

The characteristic value CQ is a value representing the product of term g(G) and term h(SC) which the air conditioning indoor units 40, 50, 60, and 70 can freely control, so the number of combinations of the degree of supercooling SC and the air volume that realize the characteristic value CQ is countless. The air conditioning indoor units 40, 50, 60, and 70 determine, from among those combinations, a combination resulting in a higher refrigerant-side heat transfer coefficient.

In the case of the automatic air volume mode, the indoor-side controllers 47, 57, 67, and 77 combine the air volume with which the characteristic value CQ can be realized at a degree of supercooling optimum value in a degree of supercooling settable range. The optimum value of the degree of supercooling SC constantly fluctuates because it is dependent on conditions such as ΔT, so the indoor-side controllers 47, 57, 67, and 77 combine the optimum air volume each time.

On the other hand, in the case of the fixed air volume mode, there is no longer the freedom to select the air volume, so the degree of supercooling SC that realizes the characteristic value CQ at that fixed air volume is unequivocally determined.

(3-2-3) Details of Interrupt Capacity Control in Heating Operation

The indoor-side controllers 47, 57, 67, and 77 use the optimum degree of supercooling determined in step S5 as the degree of supercooling target value SCt and adjust the opening degree of each of the indoor expansion valves 41, 51, 61, and 71 so that the degree of supercooling SC of the refrigerant in the refrigerant outlets of the indoor heat exchangers 42, 52, 62, and 72 becomes the degree of supercooling target value SCt.

The indoor-side controllers 47, 57, 67, and 77 next update the requested air conditioning capacity Q4 after the predetermined amount of time (e.g., three minutes) since the most recent updating, but in a case where there has been a change in the target condensation temperature Tct, the degree of supercooling target value SCt, or the air volume set value during the predetermined amount of time, the indoor-side controllers 47, 57, 67, and 77 calculate and update the requested air conditioning capacity Q4 without waiting for the elapse of the predetermined amount of time. This is the interrupt capacity control in the heating operation.

In the interrupt capacity control, when the indoor-side controllers 47, 57, 67, and 77 have received the target condensation temperature Tct from the outdoor-side controller 37, or when some kind of protective control works so that the degree of supercooling target value SCt must be changed, or when the air volume has been fixed, the indoor-side controllers 47, 57, 67, and 77 perform step S2 to step S4 of FIG. 4 and combine the degree of supercooling and the air volume with which the newly determined characteristic value CQ can be realized.

For example, when the target condensation temperature Tct has changed, term f(ΔT) of Q4=f(ΔT)·g(G)·h(SC) changes even if there is no substantial change in the requested air conditioning capacity Q4 before and after updating, so the characteristic value CQ that is g(G)·h(SC) also changes.

In order to realize the new characteristic value CQ, in the case of the automatic air volume mode, if there is an air volume with which the characteristic value CQ can be realized at the degree of supercooling optimum value in the degree of supercooling settable range, the indoor-side controllers 47, 57, 67, and 77 combine that air volume. The optimum value of the degree of supercooling SC constantly fluctuates, so the indoor-side controllers 47, 57, 67, and 77 select and determine the degree of supercooling optimum value each time and combine the air volume with which the characteristic value CQ can be realized at the determined degree of supercooling SC.

In the case of the fixed air volume mode, there is no longer the freedom to select the air volume, so the degree of supercooling SC that realizes the new characteristic value CQ at that fixed air volume is unequivocally determined.

On the other hand, in a case where, in the automatic air volume mode, the degree of supercooling target value SCt has been changed due to protective control, there is no substantial change in the requested air conditioning capacity Q4 before and after updating and there is also no change in term f(ΔT), so the value of the characteristic value CQ does not change and an air volume with which the characteristic value CQ can be realized at the changed degree of supercooling target value SCt is determined.

Furthermore, even in a case where the air volume has been changed by the user from the automatic air volume mode to the fixed air volume mode, there is no substantial change in the requested air conditioning capacity Q4 before and after updating and there is also no change in term f(ΔT), so the value of the characteristic value CQ does not change, a degree of supercooling SC with which the characteristic value CQ can be realized at the fixed air volume is determined, and that becomes the degree of supercooling target value SCt.

However, there are cases where, as a result of the air volume having been set to the minimum air volume, the requested air conditioning capacity Q4 cannot be realized even if the degree of supercooling optimum value in the degree of supercooling settable range is selected. That is to say, these are cases where the requested air conditioning capacity Q4 cannot be realized even when term g(G) of Q4=f(ΔT)·g(G)·h(SH) is a minimum and term h(SH) is optimum.

This time it is necessary to increase term f(ΔT) in order to realize the requested air conditioning capacity Q4, so the indoor-side controllers 47, 57, 67, and 77 send to the outdoor-side controller 37 a condensation temperature to be requested (the requested condensation temperature Tcr) in order to change term f(ΔT) to the necessary magnitude.

In this way, in the present embodiment normally the indoor-side controllers 47, 57, 67, and 77 perform the capacity control that updates the requested air conditioning capacity Q4 every predetermined amount of time t1 in order to cause the room temperature Tr to converge to the set temperature Ts, and when there has been a change in the target condensation temperature Tct, the degree of supercooling target value SCt, or the air volume set value during the predetermined amount of time t1, the indoor-side controllers 47, 57, 67, and 77 perform the interrupt capacity control to thereby prevent the room temperature Tr from departing from the target value in the time until the updating of the requested air conditioning capacity Q4.

(4) Characteristics (4-1)

In the air conditioner 10, the air conditioning indoor units 40, 50, 60, and 70 have the indoor-side controllers 47, 57, 67, and 77. The indoor-side controllers 47, 57, 67, and 77, in the capacity control, determine the degree of superheating target value SHt or the degree of supercooling target value SCt and/or the air volume Ga on the basis of the target evaporation temperature Tet or the target condensation temperature Tct that is set by the air conditioning outdoor unit 20, so each air conditioning indoor unit can realize stable air conditioning operations regardless of the circumstances of the other air conditioning indoor units.

(4-2)

In the air conditioner 10, the indoor-side controllers 47, 57, 67, and 77, in the capacity control, perform an optimization of the degree of superheating or the degree of supercooling so that the refrigerant-side heat transfer coefficient becomes higher, so the room temperature Tr is prevented from departing from the target value and the air volume can be minimized, which saves energy.

(4-3)

In the air conditioner 10, the indoor-side controllers 47, 57, 67, and 77 request the air conditioning outdoor unit 20 to decrease the evaporation temperature Te or increase the condensation temperature Tc when the indoor-side controllers 47, 57, 67, and 77 cannot ensure the requested air conditioning capacity in the capacity control.

For example, the indoor-side controllers 47, 57, 67, and 77 send a requested evaporation temperature to the air conditioning outdoor unit 20. However, the air conditioning outdoor unit 20 sets, as the target evaporation temperature, the evaporation temperature Te for which it is necessary to raise the operating frequency of the compressor 21 the most out of the evaporation temperatures Te requested by the indoor-side controllers 47, 57, 67, and 77, so things do not go as all of the indoor-side controllers 47, 57, 67, and 77 request.

However, in a case where a certain indoor-side controller requested a severe (low) evaporation temperature Te in order to eliminate a capacity deficiency and the requested evaporation temperature Te was lower than the evaporation temperatures Te requested by the other indoor-side controllers, the requested evaporation temperature becomes the target evaporation temperature and the capacity control expected by that indoor-side controller can be performed.

(4-4)

When there has been a change in the degree of superheating target value SHt or the degree of supercooling target value SCt, the set value of the air volume, or the target evaporation temperature Tet or the target condensation temperature Tct, the indoor-side controllers 47, 57, 67, and 77 perform the interrupt capacity control that interrupts without waiting for the periodic calculation by the capacity control and calculates and updates the requested capacity. As a result, the room temperature Tr is prevented from departing from the target value.

(4-5)

The indoor-side controllers 47, 57, 67, and 77, in the interrupt capacity control, perform an optimization of the degree of superheating or the degree of supercooling so that the refrigerant-side heat transfer coefficient becomes higher, so the room temperature Tr is prevented from departing from the target value and the air volume can be minimized, which saves energy.

(4-6)

The indoor-side controllers 47, 57, 67, and 77, in the interrupt capacity control, calculate the requested evaporation temperature Ter or the requested condensation temperature Tcr to request from the air conditioning outdoor unit 20 in order to minimize the temperature difference between the room temperature Tr and the evaporation temperature Te or the condensation temperature Tc.

It is not always the case that the requested evaporation temperature Ter or the requested condensation temperature Tcr sought from the air conditioning outdoor unit 20 is reflected in the next target evaporation temperature Tet or target condensation temperature Tct, and there are also instances where the requested evaporation temperature Ter or the requested condensation temperature Tcr sought by another indoor-side controller is reflected, but this saves more energy in the overall system including the outdoor unit.

(4-7)

When the indoor-side controllers 47, 57, 67, and 77 have received input of the target evaporation temperature Tet or the target condensation temperature Tct from the air conditioning outdoor unit 20, the indoor-side controllers 47, 57, 67, and 77 execute the interrupt capacity control regardless of whether or not the target value matches the requested value that was output to the outdoor unit. As a result, the room temperature Tr is prevented from departing from the target value.

(4-8)

The indoor-side controllers 47, 57, 67, and 77 execute the interrupt capacity control when the degree of superheating target value SHt or the degree of supercooling target value SCt has been changed in control outside their own capacity control or when the indoor-side controllers 47, 57, 67, and 77 have received input of the degree of superheating target value Slit or the degree of supercooling target value SCt from the air conditioning outdoor unit 20, and so the indoor-side controllers 47, 57, 67, and 77 prevent the room temperature from departing from the target value.

(4-9)

The indoor-side controllers 47, 57, 67, and 77 execute the interrupt capacity control when they have received input of a set value for the air volume by the manual air volume mode, and so the indoor-side controllers 47, 57, 67, and 77 prevent the room temperature Tr from departing from the target value.

(5) Example Modifications (5-1)

In the above embodiment, the degree of superheating SH and the degree of supercooling SC are employed in the capacity control parameters, but a relative degree of superheating RSH and a relative degree of supercooling RSC may also be used instead of the degree of superheating SH and the degree of supercooling SC.

Here, relative degree of superheating RSH=degree of superheating SH/(room temperature Tr−liquid pipe temperature Th2), and relative degree of supercooling RSC=degree of supercooling SC/(room temperature Tr−liquid pipe temperature Th2). The liquid pipe temperature Th2 is substituted by the detection value of the liquid-side temperature sensors 44, 54, 64, and 74.

(5-2.)

In preparation for an error in the heat exchange function, the operation amount can also be adjusted to ensure that excessive fluctuation of actuators does not occur. This is to avoid greatly changing actuators at one time from the standpoint of user comfort.

For example, in terms of the heat exchange function ($Q=f(\Delta T)\cdot g(G)\cdot h(SCH)$), actuators are operated at only 50% of the necessary operation amount for completely maintaining capacity. Specifically, they are stopped at "medium" even if the air volume is computationally "high".

(6) Other Embodiments (6-1)

Figure 7:
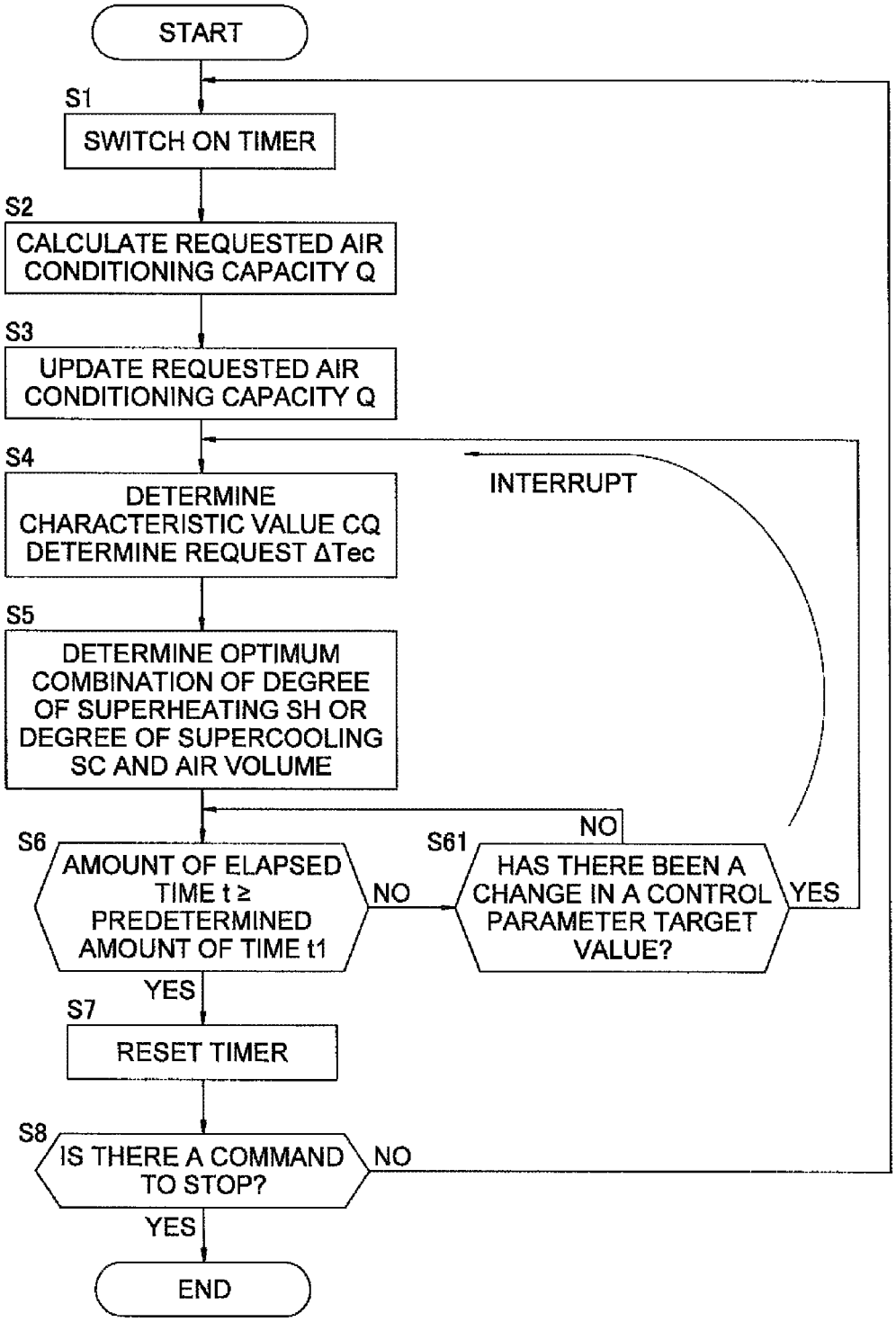
FIG. 7 is a flowchart of capacity control pertaining to another embodiment 1.

In the above embodiment, the interrupt capacity control is inserted just before step S2 in FIG. 4, but the interrupt capacity control is not limited to this and may also be inserted just before step S4 as shown in FIG. 7, for example.

There are virtually no instances where the room temperature Tr and the set temperature Ts change during the time from the updating of the requested air conditioning capacity Q to the next periodic updating, and when there has been a change in the target evaporation temperature Tet or the target condensation temperature Tct, the degree of superheating target value SHt or the degree of supercooling target value SCt, or the set value of the air volume, it suffices to omit the calculation of the requested air conditioning capacity Q and calculate only the characteristic value CQ by inserting the interrupt capacity control just before step S4.

(6-2)

Figure 8:
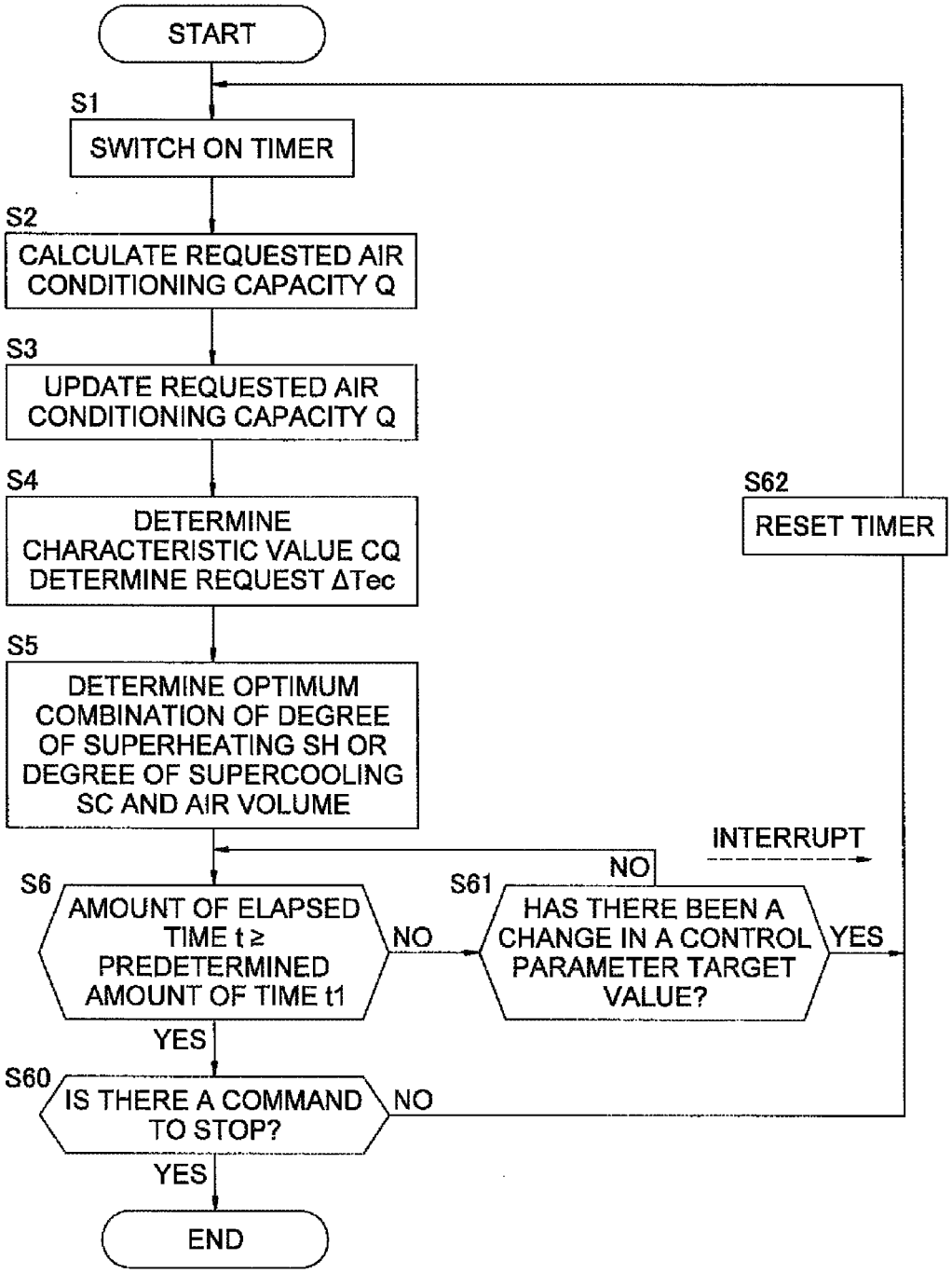
FIG. 8 is a flowchart of capacity control pertaining to another embodiment 2.

In the above embodiment, during the time from the updating of the requested air conditioning capacity Q to the next periodic updating, the indoor-side controllers wait for the updating after the predetermined amount of time t1 since the previous updating even if there is interrupt capacity control, but the indoor-side controllers are not limited to this. For example, as shown in FIG. 8, a "reset timer" command may also be inserted as step S62 on the downstream side of conventional step S61, and the next requested air conditioning capacity Q updating may be performed after the elapse of the predetermined amount of time t1 since the "updating of the requested air conditioning capacity Q by the interrupt capacity control".

In contrast to the flow of FIG. 4, step S7 in FIG. 4 is deleted and step S8 in FIG. 4 is moved up to become step S60. Because of this, the needlessness of the updating of the requested air conditioning capacity Q by the periodic capacity control being performed just after the updating of the requested air conditioning capacity Q by the interrupt capacity control is dispensed with.

(7) Applied Examples

Here, the operation of the air conditioner under specific condition settings in a case where system capacity is deficient and a case where system capacity is excessive will be described.

(7-1) Case where System Capacity is Deficient (7-1-1) Capacity Control

FIG. 9A is a table showing room temperatures of air conditioning target spaces, and air volumes and an evaporation temperature of air conditioning indoor units, in a case where system capacity is deficient. FIG. 9B is a table showing room temperatures of the air conditioning target spaces, and air volumes and an evaporation temperature of the air conditioning indoor units, in a case where an ideal state is being realized in the system from the standpoint of saving energy.

In FIG. 9A a case is supposed where air conditioning indoor units A, B, C, and D are installed. The air conditioning indoor units A, B, C, and D correspond to the air conditioning indoor units 40, 50, 60, and 70 of FIG. 1. The set temperatures of the air conditioning indoor units A, B, C, and D are 27° C. The air conditioning indoor units A, B, C, and D are cooling the air conditioning target spaces under the condition that the most recent target evaporation temperature Tet determined by the outdoor-side controller 37 is equal to 10° C.

Here, the indoor-side controllers 47, 57, 67, and 77 determine, via the air conditioning capacity calculating components 47*a*, 57*a*, 67*a*, and 77*a*, the predetermined characteristic value CQ and the request ΔTe, which is sent to the outdoor-side controller 37, on the basis of the requested air conditioning capacity Q and the most recent target evaporation temperature Tet supplied from the outdoor-side controller 37.

The requested air conditioning capacity Q is the product of term f(ΔT), which is determined by the difference ΔT between the room temperature Tr and the target evaporation temperature Tet, term g(G), which is determined by the air volume G, and term h(SH), which is determined by the degree of superheating SH; namely, $Q=f(\Delta T)\cdot g(G)\cdot h(SH)$ (hereinafter this will be called the "heat exchange function").

Below, for convenience of description, description of the operation will be given on the premise that adjustment of the capacity of each individual air conditioning indoor unit is performed using just the air volume G (term g(G) of the heat exchange function), but the term for the degree of superheating SH may also be used in combination with the air volume, and adjustment of the capacity may also be performed using the degree of superheating SH by itself.

(Operation of Air Conditioning Indoor Unit A40)

As regards the air conditioning indoor unit A40, even when the air volume is set to 100% under the condition of the current evaporation temperature Te (=10° C.), the air conditioning capacity Q1*a* is below the air conditioning load QLoa and the actual room temperature is 28° C. relative to the set temperature of 27° C. In order for the air conditioning indoor unit A40 to make up for the capacity deficiency, it is necessary to increase the value of term f(ΔT) of the heat exchange function, that is, to lower the evaporation temperature, and the evaporation temperature to be requested is 9° C.

Therefore, the indoor-side controller 47 sends to the outdoor-side controller 37 a request to lower the evaporation temperature by 1 degree, that is, request ΔTe=−1 degree, in order to realize the requested evaporation temperature Ter of 9° C.

(Operation of Air Conditioning indoor Unit B50)

Meanwhile, as regards the air conditioning indoor unit B50, given the air volume of 100% under the condition of the current evaporation temperature Te (=10° C.), the air conditioning capacity Q1*b* is not below the air conditioning load QLob and the air conditioning indoor unit B50 satisfies the necessary capacity without excess or deficiency.

Therefore, the indoor-side controller 57 sends to the outdoor-side controller 37 a request ΔTe=±0 degrees in order to request that the current evaporation temperature of 10° C. be maintained.

(Operation of Air Conditioning Indoor Unit C60)

On the other hand, as regards the air conditioning indoor unit C60, even with the air volume at 85% under the condition of the current evaporation temperature Te (=10° C.), the air conditioning capacity Q1*c* is not below the air conditioning load QLoc and the air conditioning indoor unit C60 has a latent capacity exceeding the necessary capacity.

The indoor-side controller 67 can, in order to maintain the current air conditioning capacity Q1*c* in a way that saves more energy, attempt to change the air volume Ga from the current 85% to 100% to increase the value of term g(G)× term h(SH) in the heat exchange function and in correspondence thereto decrease the value of term f(ΔT).

Decreasing the value of term f(ΔT) means raising the evaporation temperature Te, and the indoor-side controller 67 sends to the outdoor-side controller 37 a request ΔTe=+1 degree in order to request that the evaporation temperature be changed to 11° C., which is 1 degree higher than the current 10° C.

(Operation of Air Conditioning Indoor Unit D70)

Furthermore, as regards the air conditioning indoor unit D70, even with the air volume at 80% under the condition of the current evaporation temperature Te (=10° C.), the air conditioning capacity Q1*d* is not below the air conditioning load QLod and the air conditioning indoor unit D70 has a latent capacity exceeding the necessary capacity.

The indoor-side controller 77 can, in order to maintain the current air conditioning capacity Q1*d* in a way that saves more energy and according to the same way of thinking as with the air conditioning indoor unit C60, attempt to change the air volume Ga from the current 80% to 100% to increase the value of term g(G)×term h(SH) in the heat exchange function and in correspondence thereto decrease the value of term f(ΔT).

Therefore, the indoor-side controller 77 sends to the outdoor-side controller 37 a request ΔTe=+2 degrees in order to request that the evaporation temperature be changed to 12° C., which is 2 degrees higher than the current 10° C.

(Operation of Air Conditioning Outdoor Unit 20)

The outdoor-side controller 37, having received the different requests ΔTe from the indoor-side controllers 47, 57, 67, and 77 of the air conditioning indoor units, sends to the indoor-side controllers 47, 57, 67, and 77 of the air conditioning indoor units a command to set the target evaporation temperature Tet equal to 9° C. to meet the request ΔTe=−1 degree from the air conditioning indoor unit A40, which is the unit with the largest load.

(7-1-2) Interrupt Capacity Control

Normally the indoor-side controllers 47, 57, 67, and 77 next update the requested air conditioning capacity Q after the predetermined amount of time t1 (e.g., 3 minutes) since the most recent updating, but because the target evaporation temperature Tet was set equal to 9° C. during the predetermined amount of time t1, the indoor-side controllers 47, 57, 67, and 77 calculate and update the requested air conditioning capacity Q without waiting for the elapse of the predetermined amount of time t1. This is the interrupt capacity control.

How the indoor-side controllers 47, 57, 67, and 77 of the air conditioning indoor units operate after receiving "target evaporation temperature Tet=9° C." from the outdoor-side controller 37 will be described below with reference to FIG. 9B.

(Operation of Air Conditioning Indoor Unit A40)

As a result of the outdoor-side controller 37 having set the target evaporation temperature Tet equal to 9° C., the evaporation temperature Te actually drops to 9° C., the air conditioning capacity Q1*a* of the air conditioning indoor unit A40 increases, and the room temperature is able to be lowered to the set temperature of 27° C. while the air volume Ga is maintained at 100%.

Given the current evaporation temperature Te (=9° C.) and the air volume of 100%, the air conditioning capacity Q1*a* does not fall below the air conditioning load QLoa and the indoor-side controller 47 satisfies the necessary capacity without excess or deficiency.

Therefore, the indoor-side controller 47 sends to the outdoor-side controller 37 a request ΔTe=±0 degrees in order to request that the current evaporation temperature of 9° C. be maintained.

(Operation of Air Conditioning indoor Unit B50)

Meanwhile, as regards the air conditioning indoor unit B50, there is the concern that its capacity will become excessive as a result of the evaporation temperature Te having dropped to 9° C. Therefore, the indoor-side controller 57, in correspondence to the value of term f(ΔT) of the heat exchange function having increased, lowers the air volume Ga to 90% to decrease the value of term g(G)×term h(SH) and keep the air conditioning capacity Q1*b* stable.

Furthermore, the indoor-side controller 57, in order to maintain the current capacity in a way that saves more energy, can attempt to decrease the value of term f(ΔT) in the heat exchange function and change the air volume Ga from the current 90% to 100% to increase the value of term g(G)×term h(SH).

Therefore, the indoor-side controller 57 sends to the outdoor-side controller 37 a request ΔTe=±1 degree in order to request that the evaporation temperature be changed to 10° C., which is 1 degree higher than the current 9° C.

(Operation of Air Conditioning Indoor Unit C60)

On the other hand, as regards the air conditioning indoor unit C60 also, there is the concern that its capacity will become excessive as a result of the evaporation temperature Te having dropped to 9° C. Therefore, the indoor-side controller 67, in correspondence to the value of term f(ΔT) of the heat exchange function having increased, lowers the air volume Ga to 75% to decrease the value of term g(G)×term h(SH) and keep the air conditioning capacity Q1*c* stable.

Furthermore, the indoor-side controller 67, in order to maintain the current capacity in a way that saves more energy and according to the same way of thinking as with the air conditioning indoor unit B50, can attempt to decrease the value of term f(ΔT) of the heat exchange function and change the air volume Ga from the current 75% to 100% to increase the value of term g(G)×term h(SH).

Therefore, the indoor-side controller 67 sends to the outdoor-side controller 37 a request ΔTe=+2 degrees in order to request that the evaporation temperature be changed to 11° C., which is 2 degrees higher than the current 9° C.

(Operation of Air Conditioning Indoor Unit D70)

As regards the air conditioning indoor unit D70 also, there is the concern that its capacity will become excessive as a result of the evaporation temperature Te having dropped to 9° C. Therefore, the indoor-side controller 77, in correspondence to the value of term f (ΔT) of the heat exchange function having increased, lowers the air volume Ga to 70% to decrease the value of term g(G) term h(SH) and keep the air conditioning capacity Q1*d* stable.

Furthermore, the indoor-side controller 77, in order to maintain the current capacity in a way that saves more energy, can attempt to decrease the value of term f(ΔT)×term h(SH) of the heat exchange function and change the air volume Ga to 100% to increase the value of term g(G)×term h (SH).

Therefore, the indoor-side controller 77 sends to the outdoor-side controller 37 a request ΔTe=+3 degrees in order to request that the evaporation temperature be changed to 12° C., which is 3 degrees higher than the current 9° C.

(Operation of Air Conditioning Outdoor Unit 20)

The outdoor-side controller 37, having received the different requests ΔTe from the indoor-side controllers 47, 57, 67, and 77 of the air conditioning indoor units, sends to the indoor-side controllers 47, 57, 67, and 77 of the air conditioning indoor units a command to maintain the target evaporation temperature Tet at 9° C., to meet the request ΔTe=±0 degrees from the air conditioning indoor unit A40, which is the unit with the largest load.

(7-1-3) Effects

As described above, due to the outdoor-side controller 37 having lowered the evaporation temperature to 9° C., the capacity of the air conditioning indoor unit A40 increases, and by maintaining the air volume at 100% the room temperature drops to the set temperature of 27° C.

As regards the air conditioning indoor unit B50, the air conditioning indoor unit C60, and the air conditioning indoor unit D70, due to the outdoor-side controller 37 having lowered the evaporation temperature to 9° C., the interrupt capacity control works to lower the air volume and keep the room temperature stable before the capacity becomes excessive (before the room temperature drops). At the same time, the air conditioning indoor unit B50, the air conditioning indoor unit C60, and the air conditioning indoor unit D70 send requests ΔTe again to the outdoor-side controller 37.

This state that is, the state in which the air volume of the air conditioning indoor unit A, whose air conditioning load factor relative to its rated capacity is the largest among the air conditioning indoor units, is at 100% (a state in which the value of term g(G)×term h (SH) is the largest) and in which Tet is determined by the request made by the same air conditioning indoor unit is a state in which an ideal energy saving state is being realized in the system.

(7-2) Case where System Capacity is Excessive (7-2-1) Capacity Control

FIG. 10A is a table showing room temperatures of air conditioning target spaces, and air volumes and an evaporation temperature of air conditioning indoor units, in a case where system capacity is excessive. FIG. 10B is a table showing room temperatures of the air conditioning target spaces, and air volumes and an evaporation temperature of the air conditioning indoor units, in a case where an ideal state is being realized in the system from the standpoint of saving energy.

In FIG. 10A a case is supposed where air conditioning indoor units A, B, C, and D are installed. The air conditioning indoor units A, B, C, and D correspond to the air conditioning indoor units 40, 50, 60, and 70 of FIG. 1. The set temperatures of the air conditioning indoor units A, B, C, and D are 27° C. The air conditioning indoor units A, B, C, and D are cooling the air conditioning target spaces under the condition that the most recent target evaporation temperature Tet determined by the outdoor-side controller 37 is equal to 10° C. The rest is the same as the way of thinking with the capacity control of (7-1-1).

(Case of Air Conditioning Indoor Unit A40)

The capacity of the air conditioning indoor unit A40 will become excessive if the air volume is set to 100% under the condition of the current evaporation temperature Te (=10°

C.), so the air conditioning indoor unit A40 keeps the air conditioning capacity Q1*a* stable by lowering the air volume to 90%.

Here, in the air conditioning indoor unit A40, the air conditioning capacity Q1*a* can satisfy the necessary capacity with the air volume at 90% under the condition of the current evaporation temperature Te (=10° C.), so in order for the air conditioning indoor unit A40 to be able to maintain its current capacity in a way that saves more energy, the indoor-side controller 47 can attempt to decrease the value of term f(ΔT) of the heat exchange function and change the air volume Ga from the current 90% to 100% to increase the value of term g(G)×term h (SB).

Decreasing the value of term f(ΔT) means raising the evaporation temperature Te, and the indoor-side controller 47 sends to the outdoor-side controller 37 a request ΔTe=+1 degree in order to request that the evaporation temperature be changed to 11° C., which is 1 degree higher than the current 10° C.

(Case of Air Conditioning Indoor Unit B50)

The capacity of the air conditioning indoor unit B50 will become excessive if the air volume is set to 100% under the condition of the current evaporation temperature Te (=10 DC), so the air conditioning indoor unit B50 keeps the air conditioning capacity Q1*b* stable by lowering the air volume to 80%.

Here, in the air conditioning indoor unit B50, the air conditioning capacity Q1*b* can satisfy the necessary capacity with the air volume at 80% under the condition of the current evaporation temperature Te (=10° C.), so in order for the air conditioning indoor unit B50 to be able to maintain the current capacity in a way that saves more energy, the indoor-side controller 57 can attempt to decrease the value of term f(ΔT) of the heat exchange function and change the air volume Ga from the current 80% to 100% to increase the value of term g(G)×term h(SH).

Therefore, the indoor-side controller 57 sends to the outdoor-side controller 37 a request ΔTe=+2 degrees in order to request that the evaporation temperature be changed to 12° C., which is 2 degrees higher than the current 10° C.

(Case of Air Conditioning Indoor Unit C60)

The capacity of the air conditioning indoor unit C60 will become excessive if the air volume is set to 100% under the condition of the current evaporation temperature Te (=10° C.), so the air conditioning indoor unit C60 keeps the air conditioning capacity Q1*c* stable by lowering the air volume to 70%.

Here, in the air conditioning indoor unit C60, the air conditioning capacity Q1*c* can satisfy the necessary capacity with the air volume at 70% under the condition of the current evaporation temperature Te (=10° C.), so in order for the air conditioning indoor unit C60 to be able to maintain the current capacity in a way that saves more energy, the indoor-side controller 67 can attempt to decrease the value of term f(ΔT) of the heat exchange function and change the air volume Ga from the current 70% to 100% to increase the value of term g(G)×term h(SH).

Therefore, the indoor-side controller 67 sends to the outdoor-side controller 37 a request ΔTe=+3 degrees in order to request that the evaporation temperature be changed to 13° C., which is 3 degrees higher than the current 10° C.

(Case of Air Conditioning Indoor Unit D70)

The capacity of the air conditioning indoor unit D70 will become excessive if the air volume is set to 100% under the condition of the current evaporation temperature Te (=10° C.), so the air conditioning indoor unit D70 keeps the air conditioning capacity Q1*d* stable by lowering the air volume to 65%.

Here, in the air conditioning indoor unit D70, the air conditioning capacity Q1*d* can satisfy the necessary capacity with the air volume at 65% under the condition of the current evaporation temperature Te (=10° C.), so in order for the air conditioning indoor unit D70 to be able to maintain the current capacity in a way that saves more energy, the indoor-side controller 77 can attempt to decrease the value of term f(ΔT) of the heat exchange function and change the air volume Ga from the current 65% to 100% to increase the value of term g(G)×term h(SH).

Therefore, the indoor-side controller 77 sends to the outdoor-side controller 37 a request ΔTe=+4 degrees in order to request that the evaporation temperature be changed to 14° C., which is 4 degrees higher than the current 10° C.

(Operation of Outdoor-Side Controller 37)

The outdoor-side controller 37, having received the different requests ΔTe from the indoor-side controllers 47, 57, 67, and 77 of the air conditioning indoor units, sends to the indoor-side controllers 47, 57, 67, and 77 of the air conditioning indoor units a command to set the target evaporation temperature Tet equal to 11° C. to meet the request ΔTe=+1 degree from the air conditioning indoor unit A40, which is the unit with the largest load.

(7-2-2) Interrupt Capacity Control

Here, the operation of the indoor-side controllers 47, 57, 67, and 77, which have received "target evaporation temperature Tet=11° C." from the outdoor-side controller 37, will be described with reference to FIG. 10B.

The indoor-side controllers 47, 57, 67, and 77 act in accordance with "(7-1-2) Interrupt Capacity Control" described above because the target evaporation temperature Tet has been set equal to 11° C.

(Operation of Air Conditioning Indoor Unit A40)

As a result of the outdoor-side controller 37 having set the target evaporation temperature Tet equal to 11° C., the evaporation temperature Te actually rises to 11° C., so in order to maintain the air conditioning capacity Q1*a* the indoor-side controller 47 raises the air volume from the most recent 90% to 100% so as to make up for, with the value of term g(G)×term h(SH), the drop in the value of term f(ΔT) of the heat exchange function. Given the evaporation temperature Te (=11° C.) and the air volume at 100%, the air conditioning capacity Q1*a* does not fall below the air conditioning load QLoa and satisfies the necessary capacity without excess or deficiency.

Therefore, the indoor-side controller 47 sends to the outdoor-side controller 37 a request ΔTe=±0 degrees in order to request that the current evaporation temperature of 11° C. be maintained.

(Operation of Air Conditioning Indoor Unit B50)

The evaporation temperature Te has actually risen to 11° C., so in order to maintain the air conditioning capacity Q1*b* the indoor-side controller 57 raises the air volume from the most recent 80% to 90% so as to make up for, with the value of term g(G)×term h(SH), the drop in the value of term f(ΔT) of the heat exchange function.

The air conditioning capacity Q1*b* satisfies the necessary capacity under the condition of the evaporation temperature Te (=11° C.) and the air volume at 90%, so in order to maintain the current capacity in way that saves more energy, the indoor-side controller 57 can attempt to decrease the value of term f(ΔT) of the heat exchange function and change the air volume Ga from the current 90% to 100% to increase the value of term g(G)×h(SH).

Therefore, the indoor-side controller 57 sends to the outdoor-side controller 37 a request ΔTe+−1 degree in order to request that the evaporation temperature be changed to 12° C., which is 1 degree higher than the current 11° C.

(Operation of Air Conditioning Indoor Unit C60)

The evaporation temperature Te has actually risen to 11° C., so in order to maintain the air conditioning capacity Q1*c* the indoor-side controller 67 raises the air volume from the most recent 70% to 80% so as to make up for, with the value of term g(G)×term h(SH), the drop in the value of term f(ΔT) of the heat exchange function.

In the air conditioning indoor unit C60, the air conditioning capacity Q1*c* satisfies the necessary capacity under the condition of the evaporation temperature Te (=11° C.) and the air volume at 80%, so in order to maintain the current capacity in way that saves more energy, the indoor-side controller 67 can attempt to decrease the value of term f(ΔT) of the heat exchange function and change the air volume Ga from the current 80% to 100% to increase the value of term g(G)×h(SH).

Therefore, the indoor-side controller 67 sends to the outdoor-side controller 37 a request ΔTe=+2 degrees in order to request that the evaporation temperature be changed to 13° C., which is 2 degrees higher than the current 11° C.

(Operation of Air Conditioning Indoor Unit D70)

The evaporation temperature Te has actually risen to 11° C., so in order to maintain the air conditioning capacity Q1*d* the indoor-side controller 77 raises the air volume from the most recent 65% to 75% so as to make up for, with the value of term g(G)×term h(SH), the drop in the value of term f(ΔT) of the heat exchange function.

In the air conditioning indoor unit D70, the air conditioning capacity Q1*d* satisfies the necessary capacity under the condition of the evaporation temperature Te (=11° C.) and the air volume at 75%, so in order to maintain the current capacity in a way that saves more energy, the indoor-side controller 77 can attempt to decrease the value of term f(ΔT) of the heat exchange function and change the air volume Ga to 100% to increase the value of term g(G)×h(SH).

Therefore, the indoor-side controller 77 sends to the outdoor-side controller 37 a request ΔTe=+3 degrees in order to request that the evaporation temperature be changed to 14° C., which is 3 degrees higher than the current 11° C.

(Operation of Air Conditioning Outdoor Unit 20)

The outdoor-side controller 37, having received the different requests ΔTe from the indoor-side controllers 47, 57, 67, and 77 of the air conditioning indoor units, sends to the indoor-side controllers 47, 57, 67, and 77 of the air conditioning indoor units a command to maintain the target evaporation temperature Tet at 11° C. to meet the request ΔTe=±0 degrees from the air conditioning indoor unit A40, which is the unit with the largest load.

(7-2-3) Effects

As described above, due to the outdoor-side controller 37 having raised the evaporation temperature to 11° C., the capacity of the air conditioning indoor unit A40 is restrained, but by maintaining the air volume at 100% the room temperature is kept stable at the set temperature of 27° C.

As regards the air conditioning indoor unit B50, the air conditioning indoor unit C60, and the air conditioning indoor unit D70, due to the outdoor-side controller 37 having raised the evaporation temperature to 11° C., the interrupt capacity control works to increase the air volume before the room temperatures rise, and keep the room temperatures stable. At the same time, the air conditioning indoor unit B50, the air conditioning indoor unit C60, and the air conditioning indoor unit D70 send requests ΔTe again to the outdoor-side controller 37.

This state that is, the state in which the air volume of the air conditioning indoor unit A, whose air conditioning load factor relative to its rated capacity is the largest among the air conditioning indoor units, is at 100% (a state in which the value of term g(G)×term h (SH) is the largest) and in which Tet is determined by the request of the same air conditioning indoor unit is a state in which an ideal energy saving state is being realized in the system.

(7-3) Difference with Air Conditioner That Does Not Have CQ Adjusting Function

The embodiment pertaining to the present invention defines the value representing the product of term g(G) and term (h)(SCH) which the air conditioning indoor units 40, 50, 60, and 70 can freely set in the heat exchange function—namely, g(G)·h(SCH)—as the characteristic value CQ, and can eliminate an excess or deficiency in capacity and realize an ideal energy saving state by adjusting the characteristic value CQ.

Even if the air conditioner does not have a CQ adjusting function, an excess or deficiency in capacity occurs, so the room temperatures temporarily fluctuate (depart from the set temperatures); by performing feedback control with respect to fluctuations in the room temperatures it is not impossible to reach a "system energy saving ideal state" even without the CQ adjusting function.

However, in that case, the air volume, for example, is controlled by feedback after a fluctuation in the room temperatures occurs, so in that respect the operation differs from that of the embodiment of the present invention, which adjusts CQ in a feed-forward way before a fluctuation in the room temperatures occurs, and the result is that there is the potential for control to become unstable and comfort to be impaired without control being stabilized in a "system energy saving ideal state".

INDUSTRIAL APPLICABILITY

As described above, according to the present invention, temperatures (room temperatures) are kept stable by adjusting the characteristic value CQ before the temperatures (room temperatures) fluctuate, so the invention is not limited to an air conditioner but is also widely useful as a temperature adjusting device.

What is claimed is:

1. An air conditioner comprising:

an outdoor unit; and a plurality of indoor units connected to the outdoor unit, with the outdoor unit setting an evaporation temperature or a condensation temperature based on a predetermined requirement that is different from a value of an evaporation temperature or a condensation temperature that any of the indoor units has requested from the outdoor unit, the indoor units having indoor-side controllers that perform capacity control that adjusts capacity based on a degree of superheating or a degree of supercooling, an air volume, or an evaporation temperature or a condensation temperature while calculating a requested capacity that is determined from a current room temperature and a set room temperature, and the indoor-side controllers, when performing the capacity control, determining at least one of the air volume and a target value of the degree of superheating or the degree of supercooling based on the evaporation temperature or the condensation temperature that is set by the outdoor unit.

2. The air conditioner according to claim 1, wherein the indoor-side controllers select a most energy saving combination out of combinations of the degree of superheating or the degree of supercooling and the air volume that realizes the requested capacity when performing the capacity control.

3. The air conditioner according to claim 1, wherein the indoor-side controllers request the outdoor unit to decrease the evaporation temperature or increase the condensation temperature when the indoor-side controllers cannot ensure the requested capacity when performing the capacity control.

4. The air conditioner according to claim 1, wherein the indoor-side controllers perform the capacity control while periodically calculating the requested capacity, and when there has been a change in the target value of the degree of superheating or the degree of supercooling, a set value of the air volume, or the target value of the evaporation temperature or the condensation temperature, the indoor-side controllers perform interrupt capacity control that interrupts without waiting for the periodic calculation performed by the capacity control and calculates and updates the requested capacity.

5. The air conditioner according to claim 4, wherein the indoor-side controllers select a most energy saving combination out of combinations of the degree of superheating or the degree of supercooling and the air volume that realize the requested capacity that was updated when performing the interrupt capacity control.

6. The air conditioner according to claim 4, wherein the indoor-side controllers, in the interrupt capacity control, calculate an evaporation temperature or a condensation temperature to request from the outdoor unit in order to minimize a temperature difference between the current room temperature and the evaporation temperature or the condensation temperature.

7. The air conditioner according to claim 4, wherein the indoor-side controllers, when periodically calculating the requested capacity when performing the capacity control, calculate a requested value of the evaporation temperature or the condensation temperature to request from the outdoor unit, and when the indoor-side controllers have received input of a target value of the evaporation temperature or the condensation temperature from the outdoor unit, the indoor-side controllers execute the interrupt capacity control regardless of whether or not the target value matches the requested value that was output to the outdoor unit.

8. The air conditioner according to claim 4, wherein the indoor-side controllers execute the interrupt capacity control when the target value of the degree of superheating or the degree of supercooling has been changed in control outside the capacity control or when the indoor-side controllers have received input of a target value of the degree of superheating or the degree of supercooling from the outdoor unit.

9. The air conditioner according to claim 4, wherein the indoor-side controllers receive input of a set value of the air volume from one of an automatic air volume mode, in which the air volume is set automatically, and a manual air volume mode, in which the air volume is set manually, and the indoor-side controllers execute the interrupt capacity control when they have received input of a set value of the air volume by the manual air volume mode.

10. The air conditioner according to claim 2, wherein the indoor-side controllers perform the capacity control while periodically calculating the requested capacity, and when there has been a change in the target value of the degree of superheating or the degree of supercooling, a set value of the air volume, or the target value of the evaporation temperature or the condensation temperature, the indoor-side controllers perform interrupt capacity control that interrupts without waiting for the periodic calculation performed by the capacity control and calculates and updates the requested capacity.

11. The air conditioner according to claim 10, wherein the indoor-side controllers select the most energy saving combination out of combinations of the degree of superheating or the degree of supercooling and the air volume that realize the requested capacity that was updated when performing the interrupt capacity control.

12. The air conditioner according to claim 10, wherein the indoor-side controllers, in the interrupt capacity control, calculate an evaporation temperature or a condensation temperature to request from the outdoor unit in order to minimize a temperature difference between the current room temperature and the evaporation temperature or the condensation temperature.

13. The air conditioner according to claim 10, wherein the indoor-side controllers, when periodically calculating the requested capacity when performing the capacity control, calculate a requested value of the evaporation temperature or the condensation temperature to request from the outdoor unit, and when the indoor-side controllers have received input of a target value of the evaporation temperature or the condensation temperature from the outdoor unit, the indoor-side controllers execute the interrupt capacity control regardless of whether or not the target value matches the requested value that was output to the outdoor unit.

14. The air conditioner according to claim 10, wherein the indoor-side controllers execute the interrupt capacity control when the target value of the degree of superheating or the degree of supercooling has been changed in control outside the capacity control or when the indoor-side controllers have received input of a target value of the degree of superheating or the degree of supercooling from the outdoor unit.

15. The air conditioner according to claim 10, wherein the indoor-side controllers receive input of a set value of the air volume from one of an automatic air volume mode, in which the air volume is set automatically, and a manual air volume mode, in which the air volume is set manually, and the indoor-side controllers execute the interrupt capacity control when they have received input of a set value of the air volume by the manual air volume mode.

16. The air conditioner according to claim 3, wherein the indoor-side controllers perform the capacity control while periodically calculating the requested capacity, and when there has been a change in the target value of the degree of superheating or the degree of supercooling, a set value of the air volume, or the target value of the evaporation temperature or the condensation temperature, the indoor-side controllers perform interrupt capacity control that interrupts without waiting for the periodic calculation performed by the capacity control and calculates and updates the requested capacity.

17. The air conditioner according to claim 16, wherein the indoor-side controllers select a most energy saving combination out of combinations of the degree of superheating or the degree of supercooling and the air volume that realize the requested capacity that was updated when performing the interrupt capacity control.

18. The air conditioner according to claim 16, wherein the indoor-side controllers, in the interrupt capacity control, calculate an evaporation temperature or a condensation temperature to request from the outdoor unit in order to minimize a temperature difference between the current room temperature and the evaporation temperature or the condensation temperature.

19. The air conditioner according to claim 16, wherein the indoor-side controllers, when periodically calculating the requested capacity when performing the capacity control, calculate a requested value of the evaporation temperature or the condensation temperature to request from the outdoor unit, and when the indoor-side controllers have received input of a target value of the evaporation temperature or the condensation temperature from the outdoor unit, the indoor-side controllers execute the interrupt capacity control regardless of whether or not the target value matches the requested value that was output to the outdoor unit.

20. The air conditioner according to claim 16, wherein the indoor-side controllers execute the interrupt capacity control when the target value of the degree of superheating or the degree of supercooling has been changed in control outside the capacity control or when the indoor-side controllers have received input of a target value of the degree of superheating or the degree of supercooling from the outdoor unit.

* * * * *